US012702895B2

(12) United States Patent
Hagans et al.

(10) Patent No.: US 12,702,895 B2
(45) Date of Patent: Aug. 11, 2026

(54) APPARATUS AND METHOD FOR EXERCISE

(71) Applicant: Michael Hagans, Chicago, IL (US)

(72) Inventors: Michael Hagans, Chicago, IL (US); Aaron Keit, Van Nuys, CA (US)

(73) Assignee: Michael Hagans, Chicago, IL (US)

( * ) Notice: Subject to any disclaimer, the term of this patent is extended or adjusted under 35 U.S.C. 154(b) by 404 days.

(21) Appl. No.: 18/374,896

(22) Filed: Sep. 29, 2023

(65) Prior Publication Data

US 2024/0108940 A1 Apr. 4, 2024

Related U.S. Application Data

(60) Provisional application No. 63/411,866, filed on Sep. 30, 2022.

(51) Int. Cl.
*A63B 21/00* (2006.01)
*A63B 71/00* (2006.01)

(52) U.S. Cl.
CPC ..... *A63B 21/4031* (2015.10); *A63B 71/0036* (2013.01); *A63B 2225/09* (2013.01)

(58) Field of Classification Search
CPC ..... A63B 21/4031; A63B 71/0036; A63B 2225/09; A63B 21/0557; A63B 2210/50; A63B 21/4029
See application file for complete search history.

(56) References Cited

U.S. PATENT DOCUMENTS 4,635,934 A * 1/1987 Roethke ..... A63B 23/00 482/104
4,936,572 A * 6/1990 Desiderio ..... A63B 21/078 482/142
5,487,712 A 1/1996 Kann
5,575,742 A * 11/1996 Wu ..... A63B 23/0211 482/52
6,090,021 A * 7/2000 Flowers ..... A63B 21/4031 482/130
6,245,001 B1 * 6/2001 Siaperas ..... A63B 21/0552 482/142
6,805,409 B2 * 10/2004 Parker ..... A47C 9/002 297/316
7,226,400 B1 * 6/2007 Gedeon-Janvier ..... A63B 21/4031 482/106
10,576,352 B2 3/2020 Vester
10,960,256 B2 3/2021 Donnelly
11,072,464 B2 * 7/2021 Freedman ..... A45C 11/20
11,998,792 B2 * 6/2024 Poole ..... A63B 71/0036
12,208,303 B2 * 1/2025 Leavitt ..... A63B 71/0036
(Continued)

OTHER PUBLICATIONS

Zeno Gym Adjustable Freestanding Weight Bench, https://www.lowes.com/pd/Zeno-Gym-Zeno-Workout-Bench-Pro/5005339689, retrieved Oct. 30, 2023, 3 pp.

*Primary Examiner* — Andrew S Lo
(74) *Attorney, Agent, or Firm* — Greenberg Traurig, LLP

(57) ABSTRACT

An apparatus comprises a main bench body; at least one slot located on the main bench body, the slot configured to slidably receive a bar in at least one fixed position; at least one bar comprising a shape configured to be slidably inserted into the slot on the main bench body in at least one fixed position; a back rest pivotally mounted to the main bench body; a seat rest pivotally mounted to the main bench body; and at least one support lever adjustably attached to the main bench body.

17 Claims, 21 Drawing Sheets

(56) References Cited

U.S. PATENT DOCUMENTS

| | | | | |
|---|---|---|---|---|
| D1,085,294 | S * | 7/2025 | Tseng | D21/690 |
| 2006/0128540 | A1 | 6/2006 | Engle | |
| 2007/0155604 | A1* | 7/2007 | Hockemeyer | A63B 21/078 482/142 |
| 2007/0270292 | A1* | 11/2007 | Laney | A63B 22/0605 482/121 |
| 2011/0301002 | A1* | 12/2011 | Sebastian | A63B 21/068 482/142 |
| 2012/0225756 | A1* | 9/2012 | Reyes | A63B 21/078 482/104 |
| 2014/0128229 | A1* | 5/2014 | York | A63B 21/078 482/104 |
| 2016/0089558 | A1* | 3/2016 | Noyes | A63B 21/4029 482/130 |
| 2017/0100622 | A1* | 4/2017 | Wall | A63B 21/4029 |
| 2018/0236298 | A1* | 8/2018 | Donnelly | A63B 21/0726 |
| 2019/0126122 | A1* | 5/2019 | Vester | A63B 71/0036 |
| 2019/0240528 | A1* | 8/2019 | Donnelly | A63B 21/4029 |
| 2021/0121730 | A1* | 4/2021 | Clark | A63B 21/00065 |

* cited by examiner

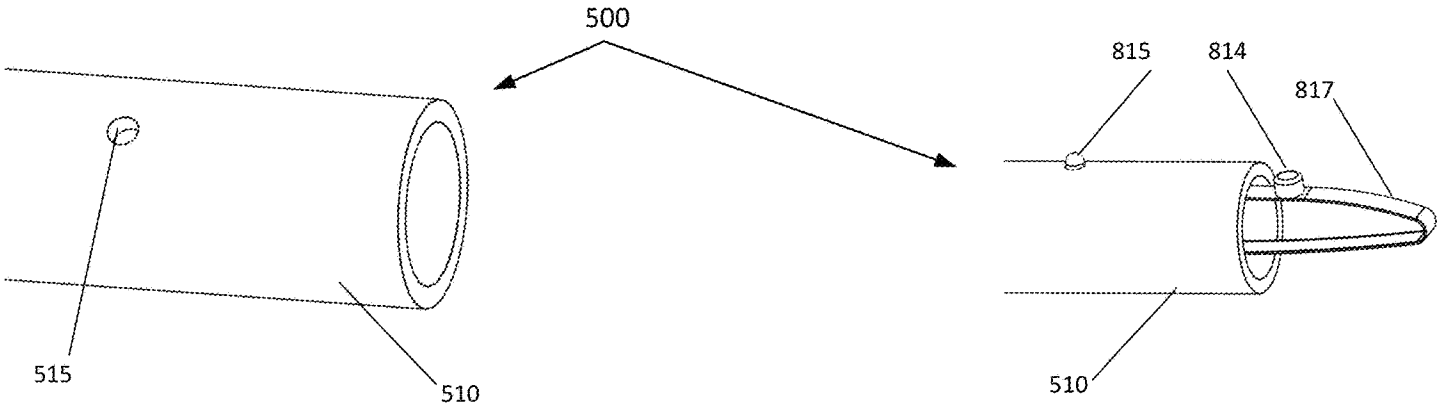
FIG. 10A
FIG. 10B
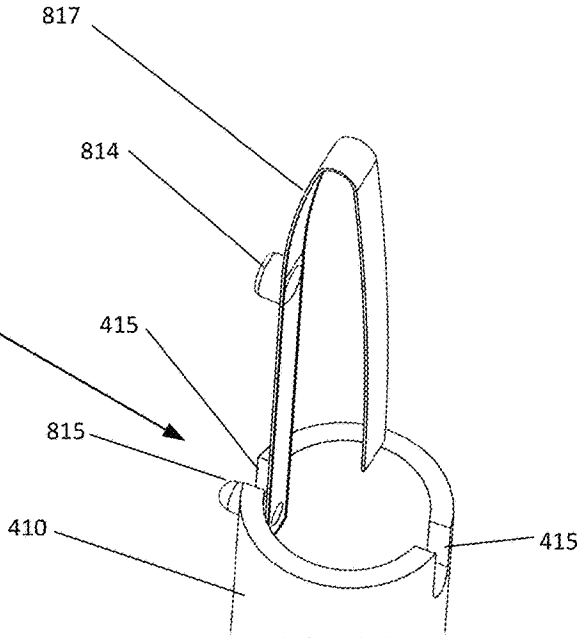
FIG. 11A
FIG. 11B

APPARATUS AND METHOD FOR EXERCISE

TECHNICAL FIELD

This disclosure generally relates to devices, apparatuses, equipment, and methods for physical bodily exercise.

BACKGROUND

In physical bodily exercise, there are at least five basic movements that are important to exercising the whole body, these movements are: a pushing movement of the upper body; a pulling movement of the upper body; a hinge forward at the waist; a lunging of the lower body or legs; and a squatting of the legs. Performing these core movements during physical exercise is important to exercising the body's main muscle groups. Retailers provide equipment to assist in performing these five basic movements of physical bodily exercise.

SUMMARY

Devices are disclosed relating to physical bodily exercise. In an example embodiment, a bench for performing various bodily exercises may include a series of slots for inserting a bar or a pair of bars into the bench, such that the bars are configured to be slidably inserted into the bench and be able to support exercises such as pull-ups and triceps dips in one configuration, and in some configurations weighted squats, incline pushups, and wheelbarrow exercises. The bench further may include an anti-tilt assembly. The anti-tilt assembly is configured to slide out and prevent the bench from tipping when using the bars as inserted into the bench.

In some embodiments, the slots on the bench may further include keying features and locking features, and the bar or bars that are configured to be slidably inserted into the bench further may include a main body and a grip segment, the main body having corresponding keying features and locking features to interact with the keying features and locking features of the slots on the bench, and the grip segment extending at an angle from the main body. The keying features of the slots on the bench and the main bodies of the bars allow for the bars to be slidably inserted into at least one, and in some embodiments many different orientations of the grip segment in relation to the surface of the bench and to one another, such that a user may exercise a wider range of motions by varying and adjusting the orientation of the grip segment of the bars by adjusting the keying features of the main body of the bars with respect to the slots on the bench. The locking features of the main body of the bars, and the corresponding locking features of the slots on the bench prevent the bars from falling out of the slots when performing various exercises.

The bench may further include a leg curl attachment and an arm curl attachment that may be removably connected to, and in some embodiments stored inside of the bench. The leg curl and arm curl attachments may be removably or temporarily attached to the bench to enable a user to perform arm curl and extension exercises and leg curl and extension exercises.

These as well as other aspects, advantages, and alternatives will become apparent to those of ordinary skill in the art by reading the following detailed description, with reference where appropriate to the accompanying drawings.

BRIEF DESCRIPTION OF THE DRAWINGS

FIG. 10A is a detail view of a horizontal bar slot assembly of the exercise device of FIG. 1.

FIG. 10B is a detail view and partial section view of a horizontal bar slot assembly of the exercise device of FIG. 1.

FIG. 11A is a detail view of a bar assembly and vertical bar slot assembly of the exercise device of FIG. 1.

FIG. 11B is a detail view and partial section view of a bar assembly and vertical bar slot assembly of the exercise device of FIG. 1.

DETAILED DESCRIPTION

Example methods and systems are described below. It should be understood that the words "example" and "exemplary" are used herein to mean "serving as an example, instance, or illustration." Any embodiment or feature described herein as being an "example" or "exemplary" is not necessarily to be construed as preferred or advantageous over other embodiments or features. In the following detailed description, reference is made to the accompanying figures, which form a part thereof. In the figures, similar symbols typically identify similar components, unless context dictates otherwise. Other embodiments may be utilized, and other changed may be made, without departing from the spirit or scope of the subject matter presented herein.

The example embodiments described herein are not meant to be limiting. It will be readily understood that the aspects of the present disclosure, as generally described herein, and illustrated figures, can be arranged, substituted, combined, separated, and designed in a wide variety of different configurations, all of which are explicitly contemplated herein.

Described herein are various embodiments of a bench for performing various physical bodily exercises. In physical bodily exercise, there are at least five basic movements that are important to exercising the full human body. Those five basic movements are: a pushing movement of the upper body; a pulling movement of the upper body; a hinge forward at the waist; a lunging of the lower body or legs; and a squatting of the legs. In the bodily exercise industry, it is important to provide equipment and apparatuses which possess the capability to perform at least one or more of the at least five basic movements. In the traditional gymnasium exercise industry and the at-home exercise industry, it is important to provide exercise equipment that is capable of more than one of the five basic movements. The more capability a piece of exercise equipment has to provide ways to perform more of the five basic movements, the less equipment is needed overall, thus saving traditional gymnasiums and at-home individuals floor space for other equipment or household fixtures, respectively.

In the current exercise equipment industry, benches exist for supporting an individual while the individual performs a pushing movement of the upper body. These benches are low to the ground and thus inefficient for providing capability to perform a pulling movement of the upper body, a lunging of the legs or a squatting of the legs. By providing a bench that also provides a modular system of attachments and storage for the attachments, more of the basic five movements can be achieved while saving space. The aspects, embodiments, devices, and methods disclosed herein teach an apparatus and a method for providing a piece of workout equipment that accommodates at least five of the basic movements needed to exercise the full human body.

Figure 1:
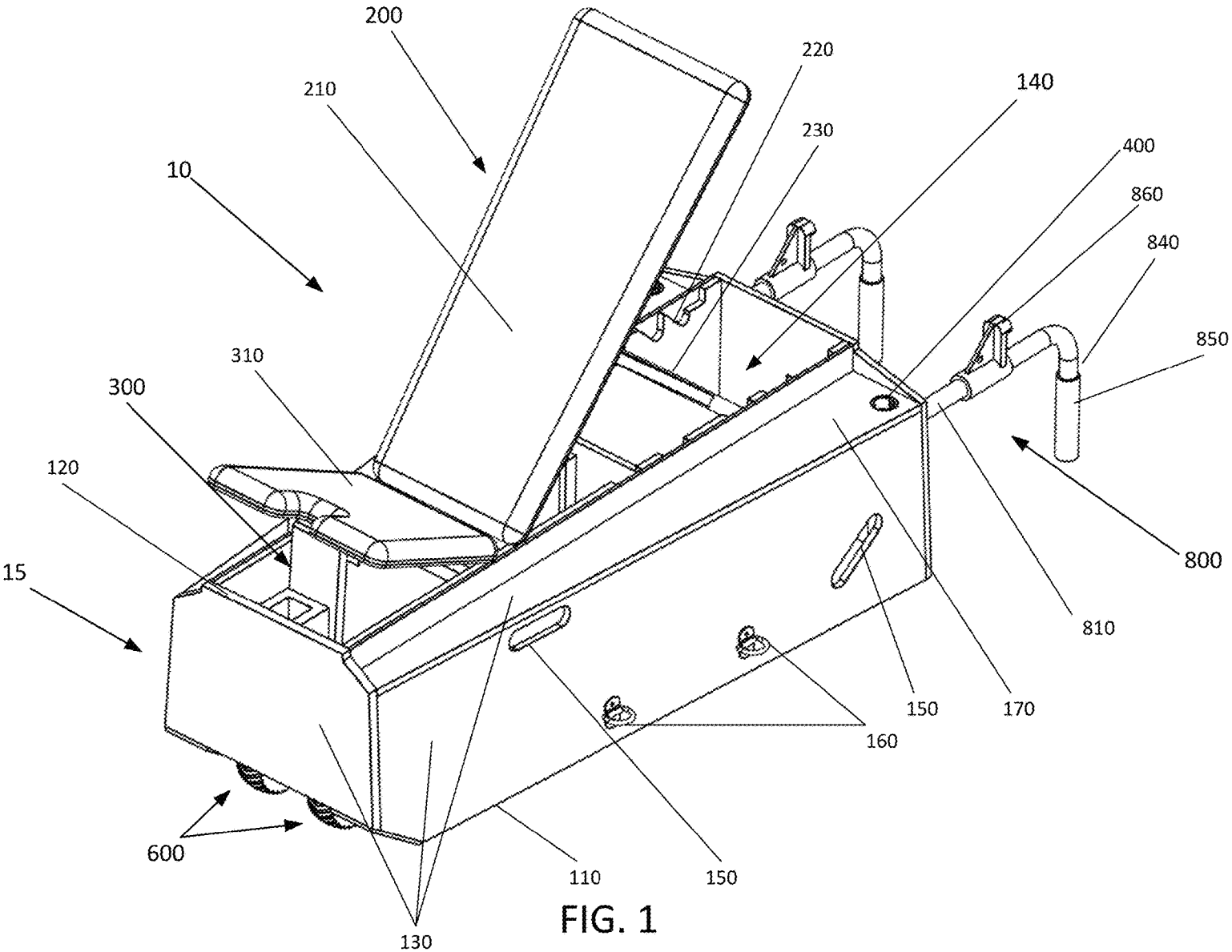
FIG. 1 is a front-side overall isometric view of an exercise device.
Figure 2:
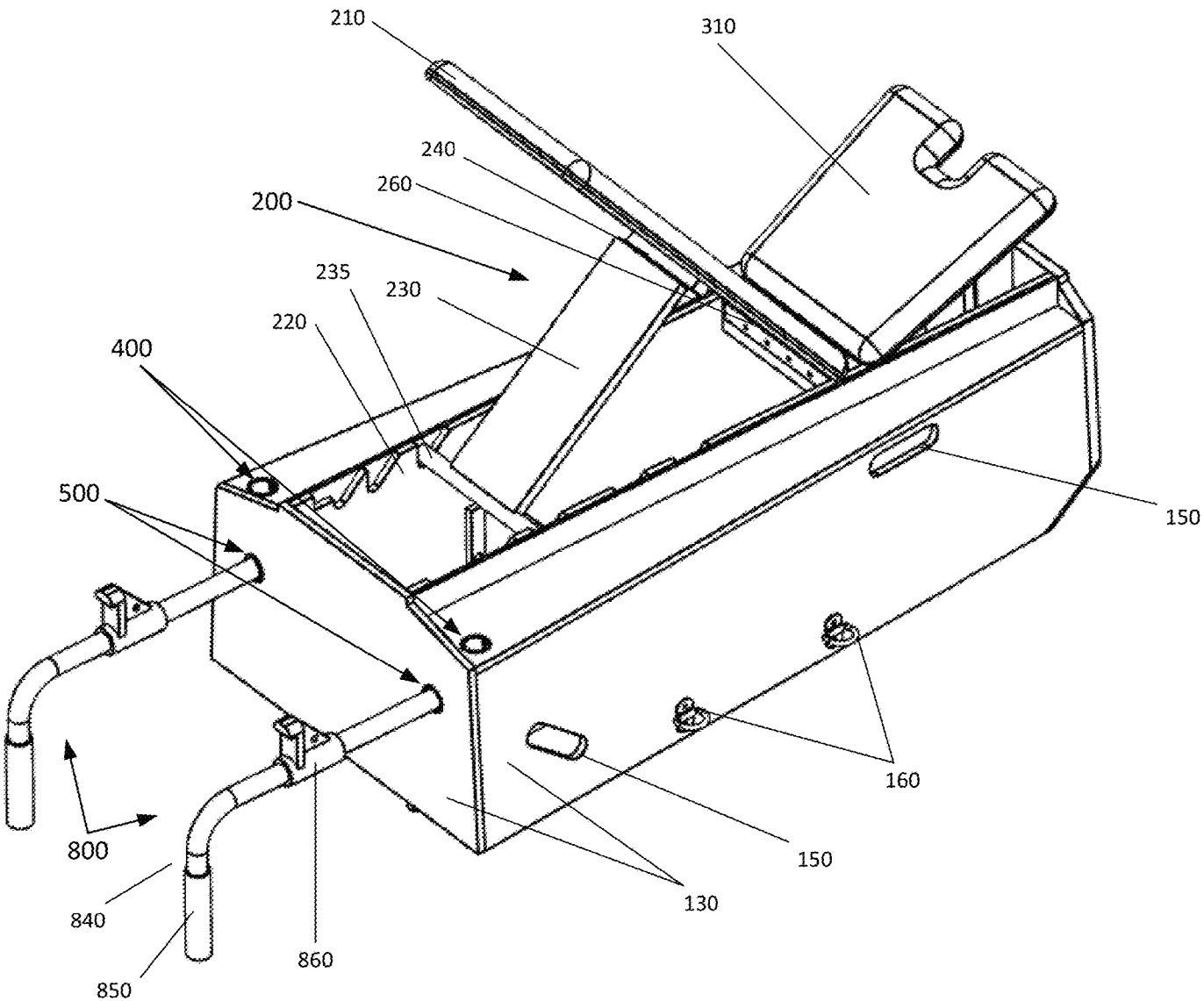
FIG. 2 is a rear-side overall isometric view of the exercise device of FIG. 1.

Referring now to the drawings wherein like reference numerals are used to identify identical components in the various views, in one embodiment as shown from one perspective in FIG. 1, and from a different perspective in FIG. 2, an exercise device 10 may include a bench 15, at least one bar assembly 800, vertical and horizontal bar slot assemblies 400, 500 that may be configured to receive the bar assemblies 800, and an anti-tilt assembly 700 that may be fastened to the bench 15. In some embodiments, the exercise device 10 may further include any or all of an internal storage space 140, at least one handle 150, at least one resistance band attachment point 160, a back rest adjustment assembly 200, a seat rest adjustment assembly 300, a wheel assembly 600, and an attachment module 900 that may be configured to receive a leg curl attachment 930, and arm curl attachment 940.

In one embodiment, shown in FIG. 1, the bench 15 may be made or formed from fastening a plurality of panels together to form a structure with a top surface 120, a bottom surface 110, and a plurality of side surfaces 130. Each of the top surface 120, bottom surface 110, and side surfaces 130 may be substantially planar surfaces that may be structured to support force applied perpendicularly (e.g., by a user sitting on a surface). The top surface 120 and bottom surface 110 may connect to the side surfaces 130 at a right angle, such that the surfaces collectively form a substantially rectangular shape. In some embodiments, the bench 15 may be formed from a single piece of material, cast as one piece, or otherwise fabricated using accepted manufacturing techniques. The bench bottom surface 110 may be configured to rest on the ground. The bench top surface 120, or second outer surface, may be substantially parallel to the bench bottom surface 110. In some embodiments, the second outer surface 120 may be configured to be on an incline or a decline with respect to the bench bottom surface 110 (e.g., via back rest adjustment assembly 200).

Figure 14A:
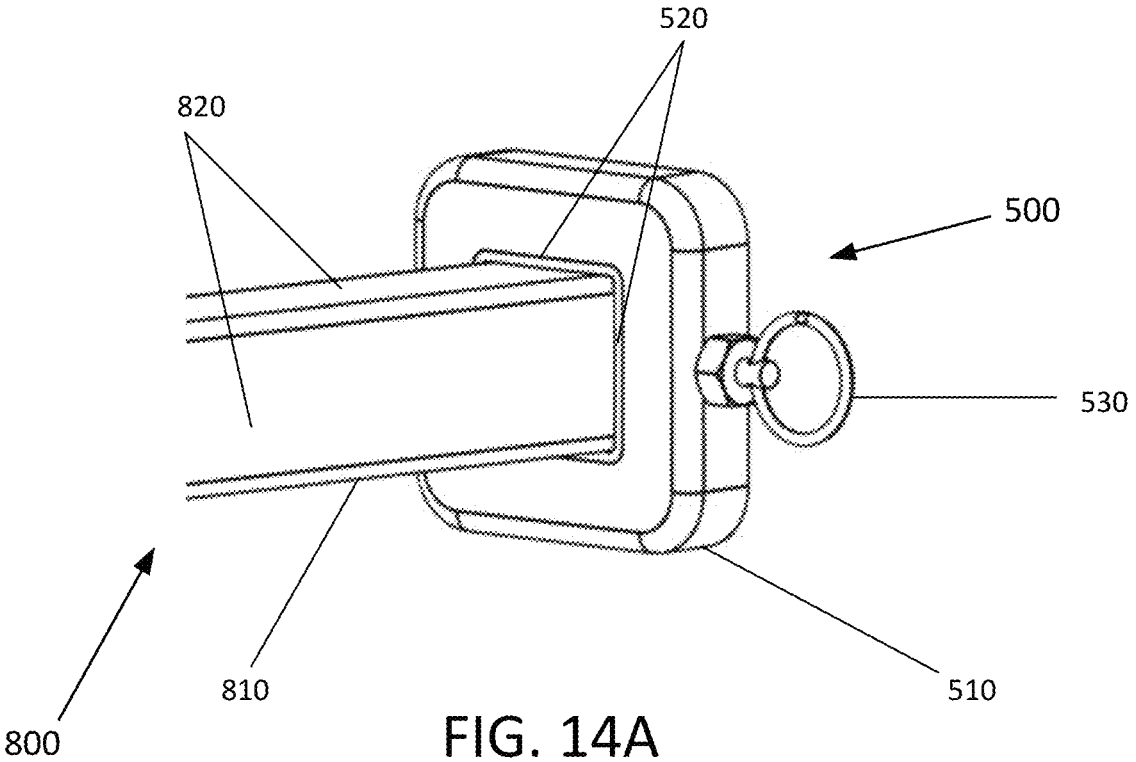
FIG. 14A is a detail view of a second configuration of a bar assembly and horizontal bar slot assembly of FIG. 11A.
Figure 14B:
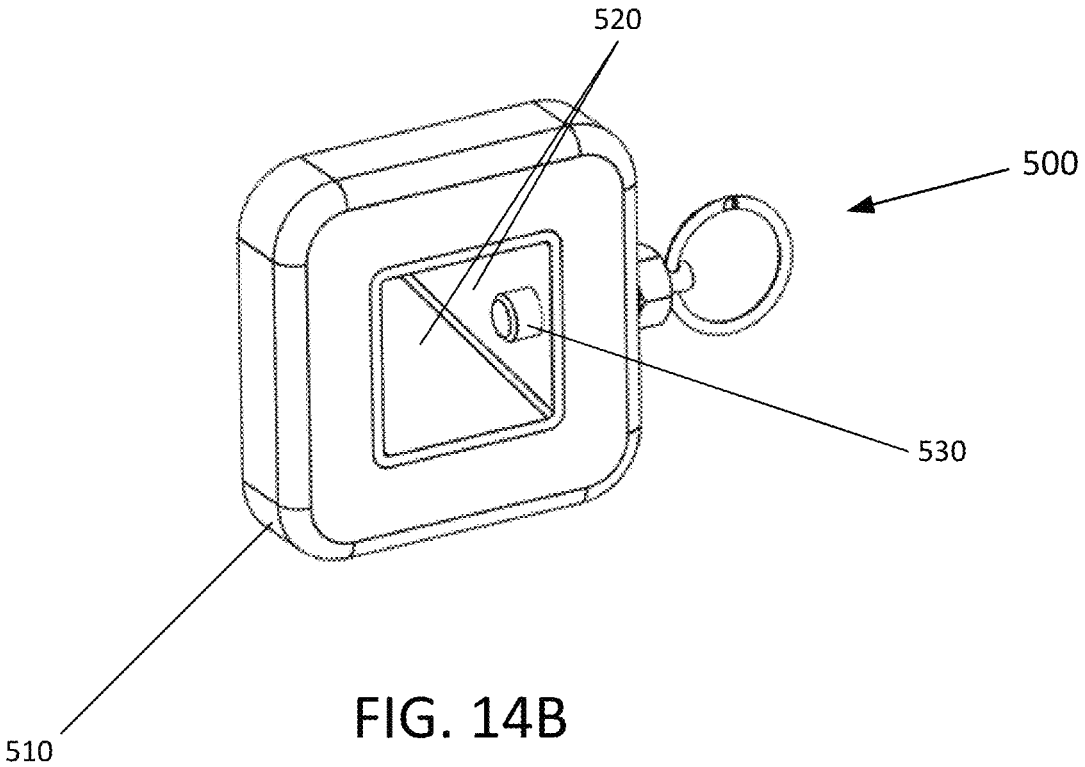
FIG. 14B is a detail view of a second configuration of a horizontal bar slot assembly of FIG. 11A.
Figure 14C:
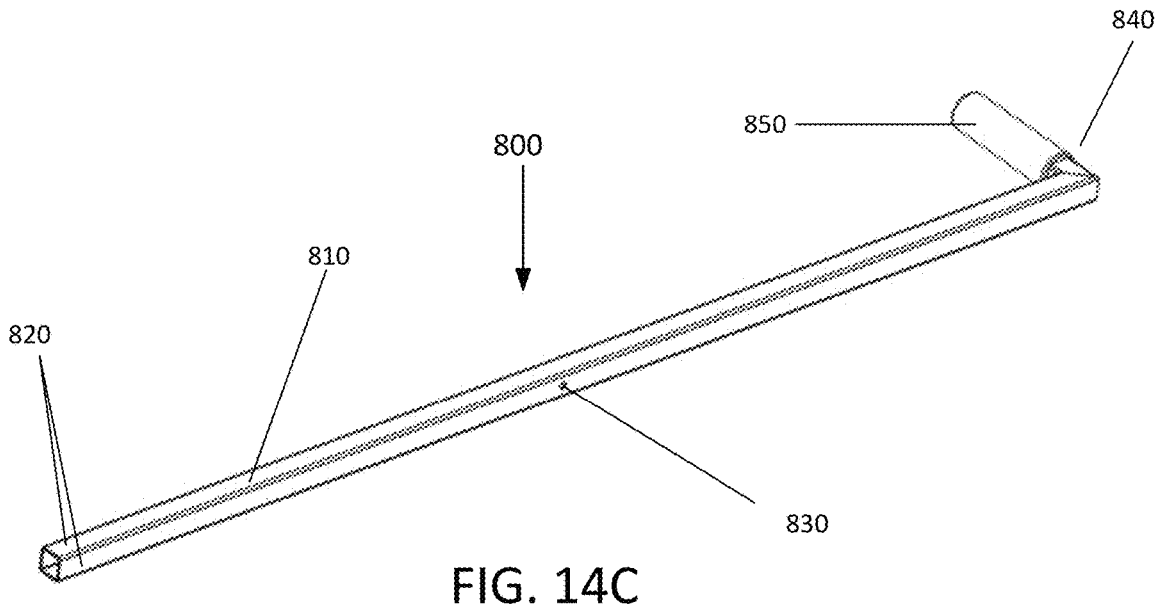
FIG. 14C is a detail view of a second configuration of a bar assembly of the exercise device of FIG. 1.

As shown in FIG. 1 and in greater detail in FIG. 14C, the exercise device 10 may include at least one bar assembly 800. The bar assembly 800 may include a main body 810, a main body keying geometry 820, a main body locking geometry 830, a grip segment 840, and a grip surface 850. The bar assembly 800 may be configured to be slidably inserted into any one of a vertical bar slot assembly 400 or horizontal bar slot assembly 500 located on the bench 15 of the exercise device 10. In the embodiment shown, the main body 810 may be made from a tube stock, which may include a length and a profile shape, and which may either be a metal, composite, wood, or other material. Each different material may have different benefits such as increased manufacturability, weight, or cost savings, but accomplish the same result by functioning in the same way.

Figures 11C, 11D:
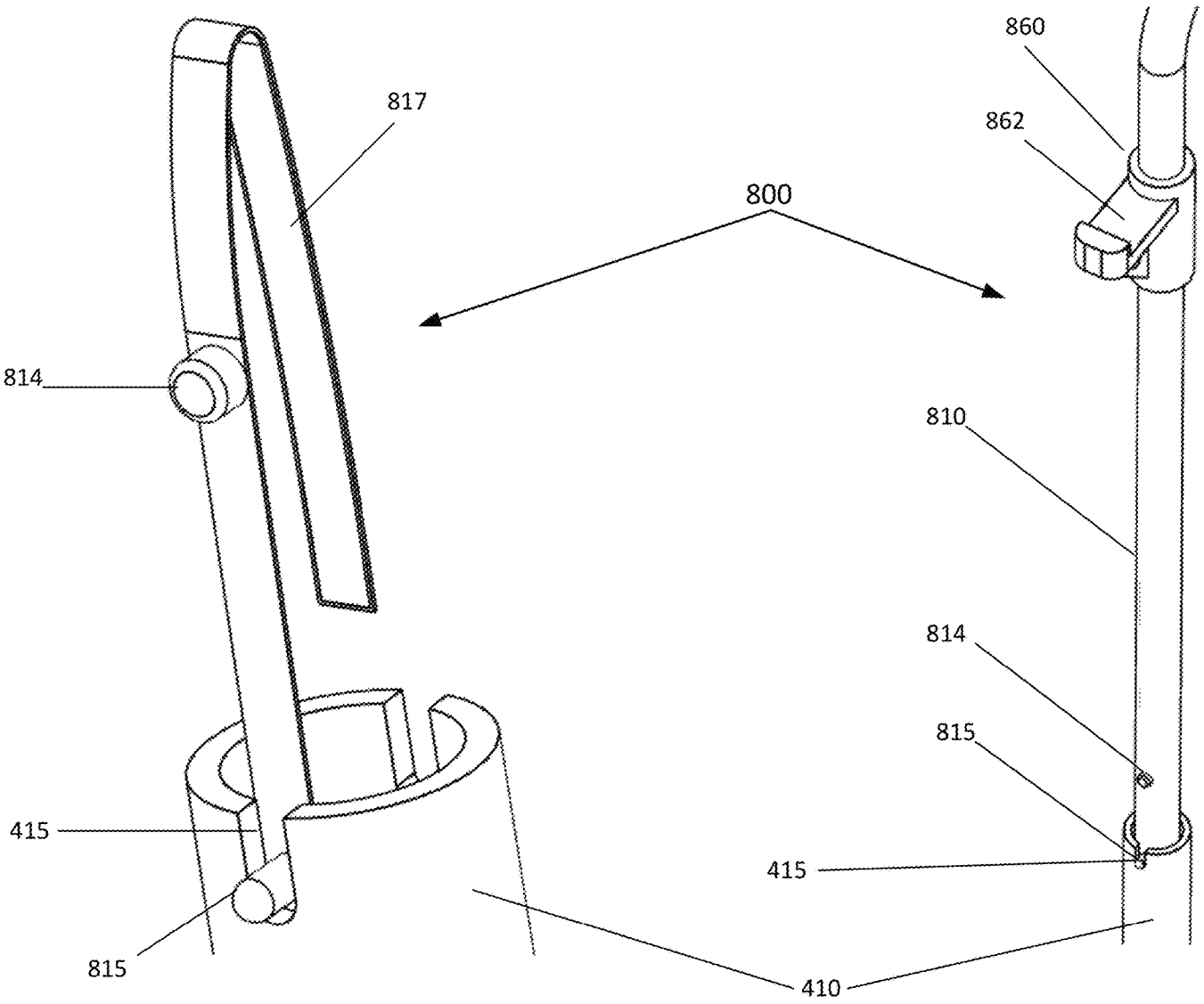
FIG. 11C is a detail view and partial section view of a bar assembly and vertical bar slot assembly of the exercise device of FIG. 1.
FIG. 11D is a detail view of a bar assembly and vertical bar slot assembly of the exercise device of FIG. 1.
Figure 12:
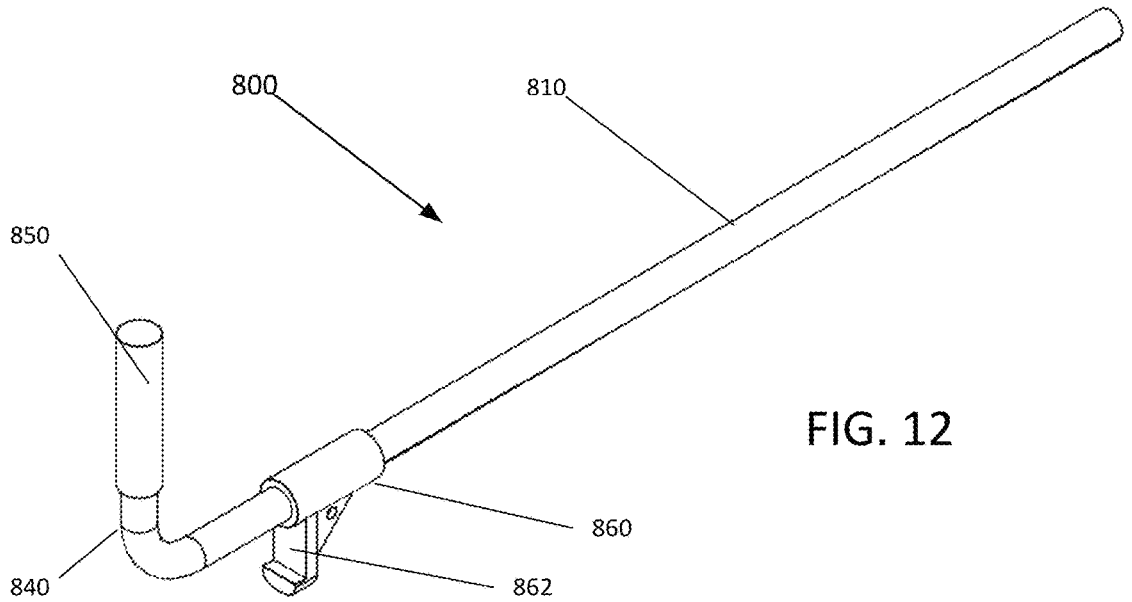
FIG. 12 is a detail view of a bar assembly of the exercise device of FIG. 1.

In some embodiments, as shown in FIG. 12 and in detail in FIGS. 10A-10B and FIGS. 11A-11D, the bar main body 810 of the bar assembly 800 may include holes cut into the length of tube stock of the main body 810, and a protrusion 815 connected to an elastic member 817 located inside of the main body 810 of the bar assembly 800. The protrusion 815 may be configured to engage with holes in a vertical or horizontal bar slot assembly 400, 500 in order to constrain or lock the bar assembly 800 within the bar slot assemblies 400, 500.

In some embodiments, the bar assembly 800 may be pivotably coupled to the exercise device 10, such that the bar assembly 800 may pivot between a horizontal position (e.g., in the horizontal bar slot assembly 500) and a vertical position (e.g., in the vertical bar slot assembly 400). In these embodiments, the bar assembly 800 may further include support structures that fix the bar assembly 800 in either the horizontal or the vertical position to provide additional support (e.g., to accommodate the body weight of a user).

In some embodiments, the bar assembly 800 may be slidably stored in the exercise device 10 in a substantially horizontal position. In these embodiments, the bar assembly 800 may be slid-out from within the exercise device 10 into an extended horizontal position for use (e.g., to pull the exercise device using the wheel assembly 600), and then further pivoted into a vertical position for use (e.g., dip exercises). The bar assembly 800 may include a protrusion 815 connected to an elastic member 817 inside of the bar assembly 800 main body 810 to fix the bar assembly 800 in each of the stored (e.g., retracted) horizontal position, extended horizontal position, and vertical position. The protrusion 815 may be released or depressed into the main body 810 of the bar assembly 800 via a button or similar release on the bar assembly 800 to enable movement of the bar assembly 800.

In the embodiment shown in FIG. 14A-D, the main body 810 may be made from square tube stock, however the main body 810 may be made with any other geometric shape and profile to accomplish the same result by functioning in the same way as a square profile. In the embodiment shown, the main body keying geometry 820 may include the square profile of the square tube stock used to manufacture the main body 810. As discussed in depth with regard to FIGS. 14A-D, the keying geometry 820 of the main body 810 may align with the interior faces or keying geometry 420, 520 of the vertical and horizontal bar slot assemblies 400, 500 to maintain a rotational orientation of the bar assembly 800 relative to a central axis defined by the length of the main body 810 (e.g., prevent the bar assembly 800 from rotating). In the example shown in FIG. 14D, the keying geometry 420 may be substantially-star shaped to enable the bar assembly 800 to be rotated at 45° intervals, while in the example shown in FIG. 14B, the keying geometry 520 may be substantially-square to enable the bar assembly 800 to be rotated at 90° intervals. In other embodiments, each of the keying geometries 420, 520 may be either square or star-shaped, as desired.

In some embodiments, such as the embodiment shown in FIG. 12, the main body 810 may be made from round stock, such that the main body 810 may interface with a relatively round interior face of a vertical or horizontal slot insert 410, 510 shown in FIGS. 10A and 11A. The slot inserts 410, 510 may be part of the vertical and horizontal bar slot assemblies 400, 500, such that the main body 810 may be received by the vertical and horizontal bar slot assemblies 400, 500 via the slot inserts 410, 510. Because the round shapes would otherwise enable free rotation, the main body 810 may include a protrusion 815 that may be sized and shaped to extend into a corresponding recess 415, 515 of the slot inserts 410, 510. The extension of the protrusion 815 may prevent movement of the main body 810, such that the main body 810 is held in substantially the same position and orientation relative to the vertical and horizontal bar slot assemblies 400, 500 when the protrusion 815 is extended into the recess 415, 515. To this end, multiple recesses 415, 515 may be included about the slot inserts 410, 510, which would enable the main body 810 to be fixed in different positions (e.g., for longer or shorter functional lengths) and in different orientations (e.g., rotatable).

As shown in FIGS. 11A-11D, the main body 810 may include a unlock button 814 that may be connected to an elastic member 817, and such unlock button 814 is configured to control an extension of the protrusion 815. The unlock button 814 may include an interface that is accessible for a user to enable the user to control the protrusion 815 at a location separate from that of the protrusion 815. For example, the unlock button 814 may include a button or switch near the grip segment 840, and in some embodiments along the length of the main body 810 of the bar assembly 800 that, when pressed, may either extend or compress the elastic member 817, and therefore extend or retract the protrusion 815.

The protrusion 815 may be connected to the elastic member 817 such that the elastic member 817 biases the protrusion 815 outward from the main body 810 of the bar assembly 800 and enables movement of the protrusion 815 when the elastic member 817 is compressed or otherwise manipulated. As such, a user may depress the protrusion 815 by interacting with either the protrusion 815 or the unlock button 814, which may compress or otherwise manipulate the elastic member 817, allowing the protrusion 815 to move to a position inside of the main body 810 which therefore would enable the main body 810 to move, pivot, or rotate.

As shown in detail in FIG. 14C, the bar assembly 800 may include a locking geometry 830 which may also be located in the main body 810. In the embodiment shown in FIG. 14C, the locking geometry 830 may include a hole cut into the tube stock of the main body 810. The locking geometry 830 may allow for a lock pin 530 of the horizontal bar slot assembly 500, shown in FIG. 14B, to be inserted into the locking geometry 830 of the main body 810 of the bar assembly 800, thus preventing the bar assembly 800 from being slidably removed from the horizontal bar slot assembly 500 during exercise. In some embodiments, the locking geometry 830 may be geometry other than a hole, such as a slot, an indent, a ridge, or other mechanical locking means.

Shown in FIG. 14C, the bar assembly 800 may include a grip segment 840 which may be fastened to or extending from the main body 810 of the bar assembly. The grip segment 840 may include the same material as the main body 810 or may include a different material than the main body 810. In the embodiment shown, the grip segment 840 may be made from the same square tube stock material as the main body 810. The grip segment 840 may be a different piece of tube stock that is welded or mechanically fastened to the main body 810 at a right or substantially right angle. In some embodiments, the grip segment 840 may be fastened at angles other than a right angle to the main body 810. In some embodiments the grip segment 840 may be made from the same piece of material as the main body 810 and may be bent at any angle from the main body 810 using mechanical methods.

The bar assembly 800 may further include a grip surface 850 that may be placed over the grip segment 840 of the bar assembly 800. The grip surface 850 may be made from a rubber material, grip tape material, composite material, or any number of other materials. In one embodiment, the grip surface 850 may be molded directly over the grip segment 840 by pouring material over the grip segment 840 or by dipping the grip segment 840 into material. In some embodiments the grip surface 850 may be formed separately and placed over the grip segment 840.

Figure 4A:
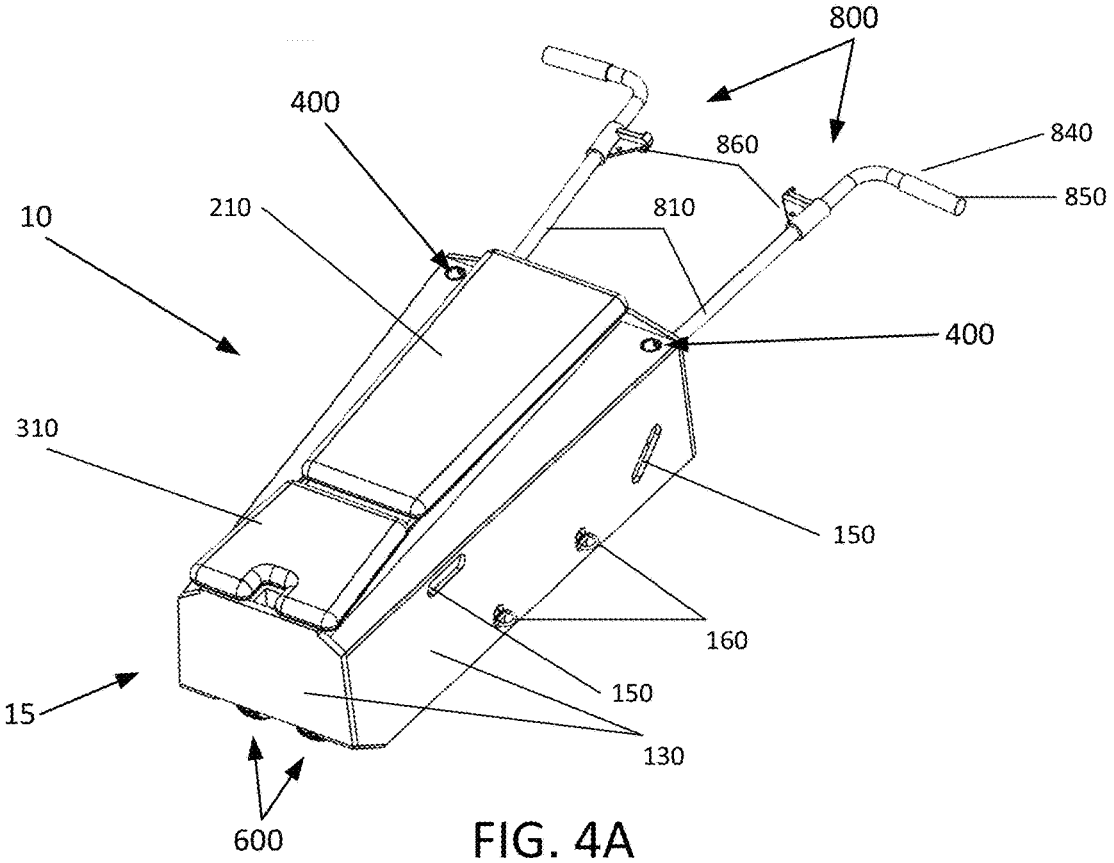
FIG. 4A is an overall isometric view of the exercise device of FIG. 1 in a first configuration.
Figure 4B:
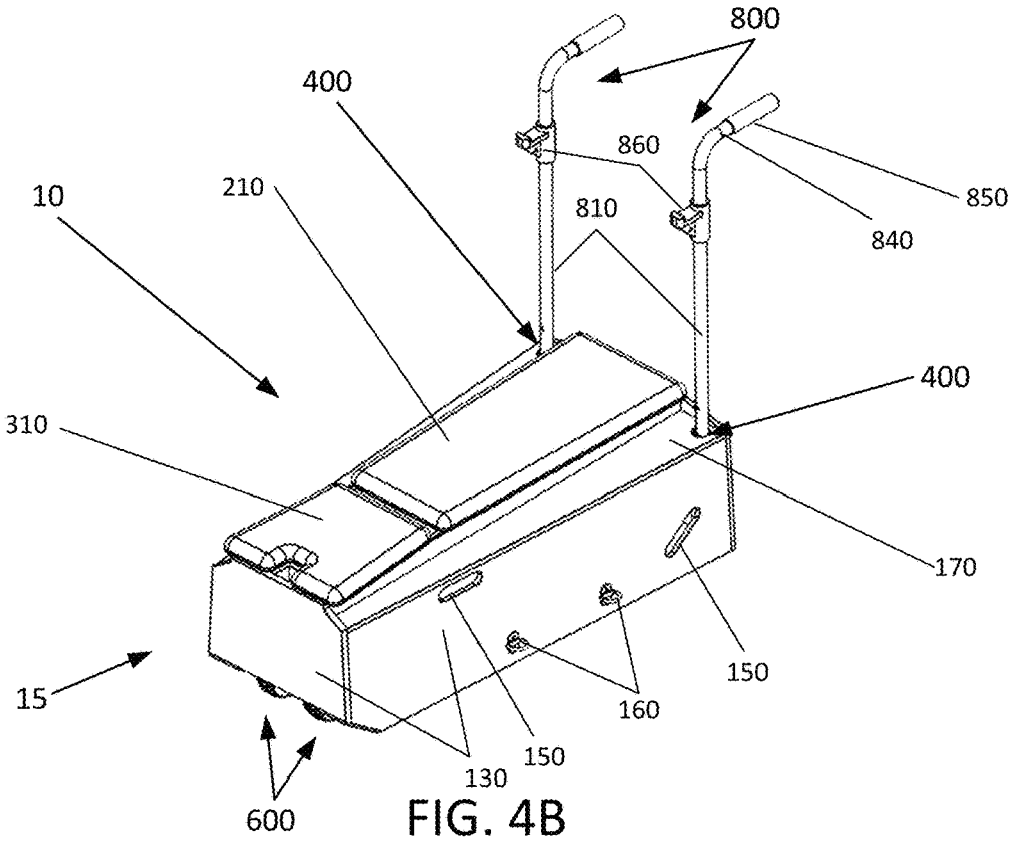
FIG. 4B is an overall isometric view of the exercise device of FIG. 1 in a second configuration.
Figure 4C:
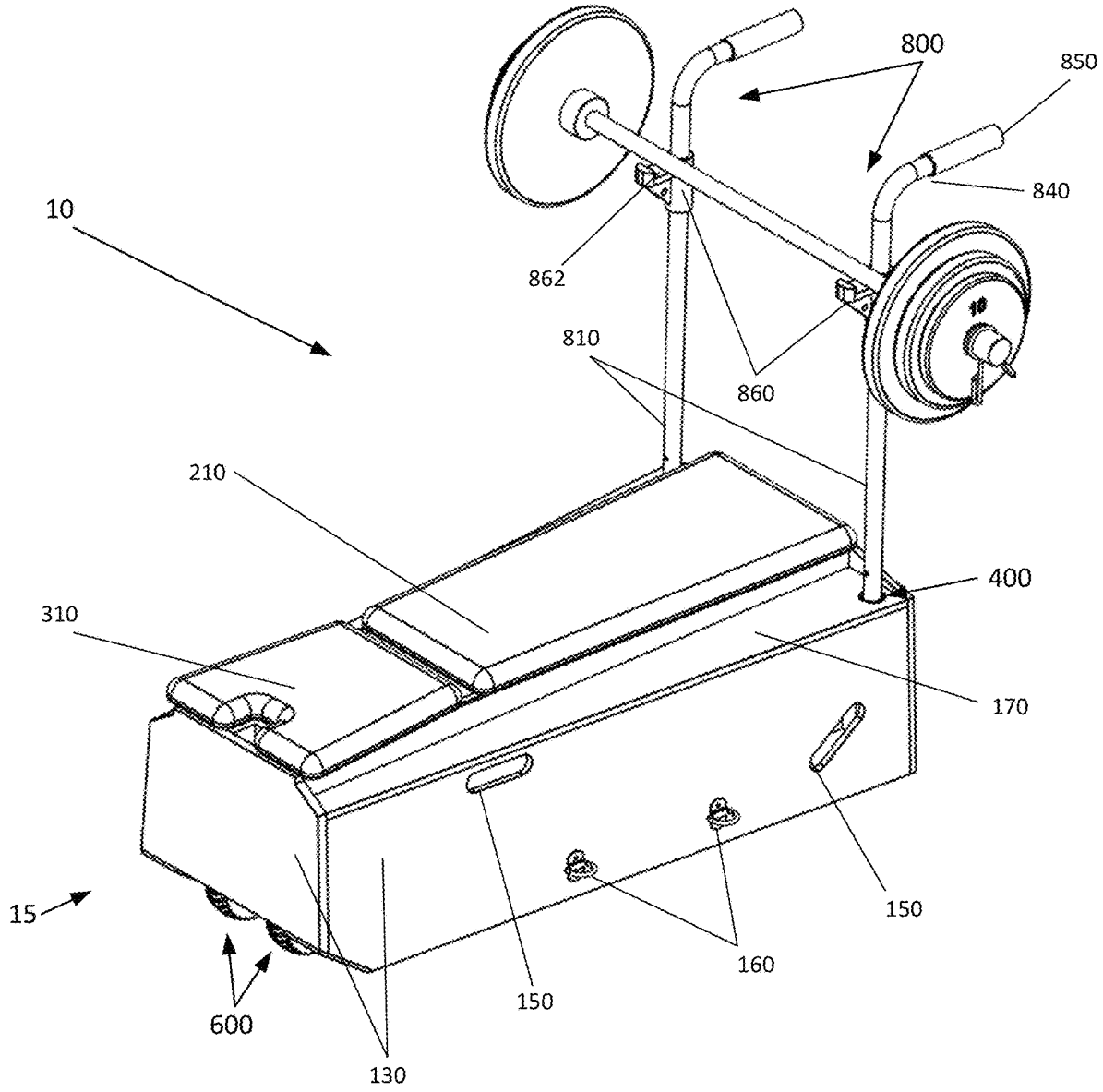
FIG. 4C is an overall isometric view of the exercise device of FIG. 1 in a third configuration.

As shown in FIG. 11D and in FIGS. 4B-4C, the bar assembly 800 may further include a bar support clip 860. The bar support clip 860 may be located on the main body 810 of the bar assembly 800, and may be fastened to the main body 810 of the bar assembly by mechanical fasteners, press fit, or other mechanical means. In some embodiments, the bar support clip 860 may be in a substantially-fixed position, such that the bar support clip 860 may not be moved along a length of the main body 810 once in place. In some embodiments, the bar support clip 860 may be selectively-fixed to the main body 810, such that the bar support clip 860 may be "unlocked" and moved along the length of the main body 810 before being "locked" in place again. The bar support clip 860 may be made from plastic, metal, wood, or any other material or composite of material, and may be machined, cast, or made integral to the main body 810 by casting, machining, or other manufacturing processes. The bar support clip 860 may further include a shelf protrusion 862, and the shelf protrusion 862 may be configured to support additional bars or weights during use of the device 10. The bar support clip 860 may further include a resistance band attachment point 160 configured to allow resistance bands to be attached to the bar support clip 860.

Figure 14D:
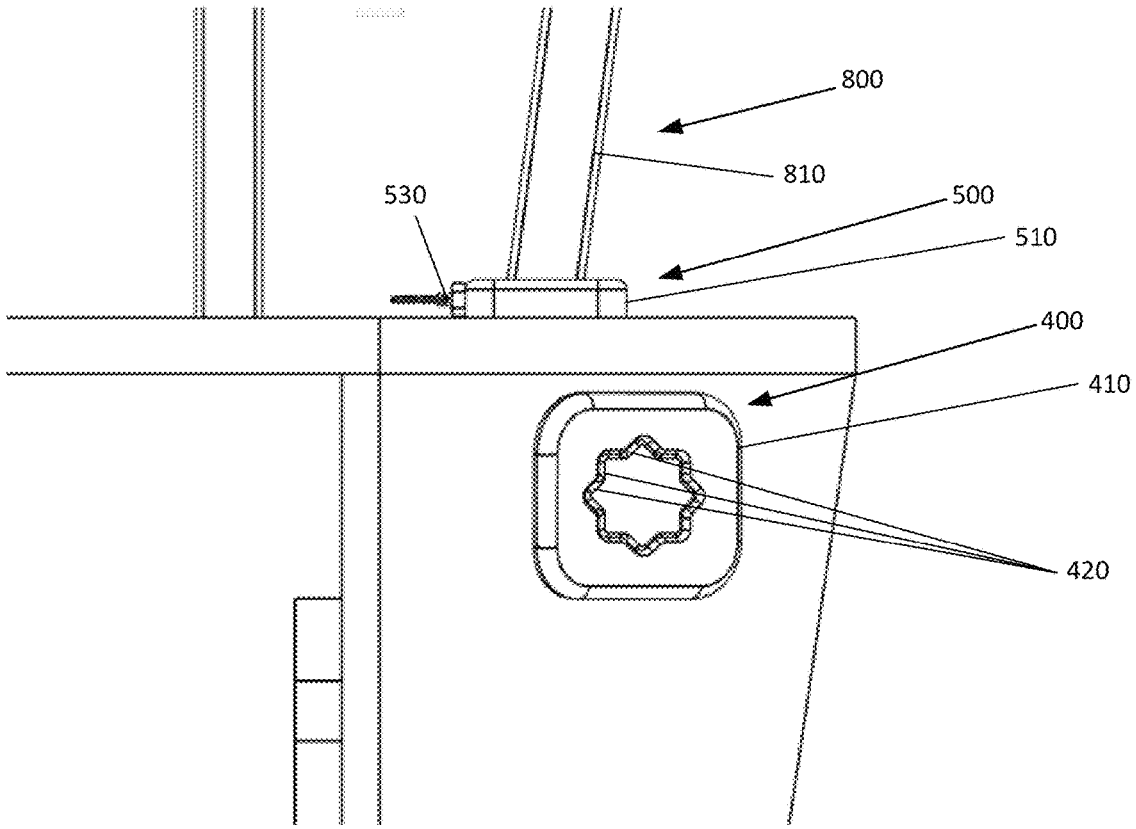
FIG. 14D is a detail view of a second configuration of the exercise device of FIG. 1.

In one embodiment, shown in FIG. 1, and in greater detail in FIG. 14D and in FIGS. 11C-11D, the bench 15 may include at least one vertical bar slot assembly 400. In some embodiments, the bench 15 may include a pair of vertical bar slot assemblies 400 that are positioned on opposite (and mirrored) positions, relative to an axis defined by a length of the bench. The vertical bar slot assembly 400 may include a slot insert 410 and a keying geometry 420. The vertical bar slot assembly 400 may be configured to slidably receive a bar assembly 800. The vertical bar slot assembly 400 may be located on the top surface 120 of the bench 15, or may be located on a flare-out side 170 of the bench 15, which may leave room for a back rest adjustment assembly 200. In the embodiment shown in FIG. 1 and FIG. 4B, the bench 15 may include a set of two vertical bar slot assemblies 400. In the embodiment shown, the slot insert 410 of the vertical bar slot assembly 400 may extend inside of the bench 15. In some embodiments, the vertical bar slot assemblies 400 may extend out from the bench 15. Each vertical bar slot assembly 400 may be positioned substantially perpendicular to the bottom surface 110 of the bench 15. In some embodiments, bar slot assemblies may be positioned at any plurality of angles with respect to the bottom surface 110 of the bench 15.

Each vertical bar slot assembly 400 may include a slot insert 410 that may be fastened to the bench 15. The slot insert 410 may include side walls which together make up the keying geometry 420 of the vertical bar slot assembly 400, and which slidably interacts with the keying geometry 820 of the bar assembly 800 to support the bar assembly 800 during loading which may occur during use of the exercise device 10. The slot insert 410 may be made from a metal, composite, wood, or other material that may be extruded as a tube stock, machined, molded, forged, or otherwise manufactured, and may be fastened to the bench 15 by mechanical means to support the bar assembly 800 when inserted into the bench 15. The slot insert 410 may be press fit into the bench 15, or in some embodiments fastened to the inside of the bench 15 or on the surface of the bench 15 using mechanical fastening methods. The slot insert 410 may be an independent component or may, in some embodiments, be integral to the bench 15 by molding, casting, or otherwise manufacturing the slot insert 410 as one piece with the bench 15. The slot insert 410 may be configured to slidably receive a bar assembly 800.

As shown in one embodiment, in FIGS. 14C-14D, the slot insert 410 may further include side walls which together make up a keying geometry 420. The keying geometry 420 may be configured to vertically and slidably receive the bar assembly 800. The bottom or back wall of the slot insert 410 supports the bar assembly 800 and prevents the bar assembly from moving further into the bench 15, and the keying geometry 420 of the slot insert 410 may constrain the motion of the bar assembly 800 from side-to-side movements and may prevent any rotation of the bar assembly 800. The slot insert 410 may contain many side walls that make up the keying geometry 420, so that the keying geometry 420 may accept the bar assembly 800 in a plurality of rotated positions of the grip segment 840. The keying geometry 420 may further be configured to prevent rotation of the bar assembly 800 when installed in the slot insert 410. In the embodiment shown in FIG. 14D the keying geometry 420 may include one square shape that is rotated at an offset from another square shape to form an eight-pointed star, such that the keying geometry 820 of the bar assembly 800 may fit into the keying geometry 420 of the slot insert 410 of the vertical bar slot assembly 400 at eight unique positions. In some embodiments, different keying geometry for the interface between the bar assembly 800 and the vertical bar slot assembly 400 may be used, to function with the same result of adjustability of the bar assembly 800.

In some embodiments, such as the one shown in FIGS. 11A-11D the vertical bar slot assembly 400 may include a slot insert 410 that is substantially circular in profile. The inner circular wall of the slot insert 410 may be configured to slidably receive the main body 810 of the bar assembly 800. The slot insert 410 may include a keying geometry 420 that includes a recess 415 cut out from the slot insert 410. The recess 415 may be configured to receive a corresponding protrusion 815 from the main body 810 of the bar assembly 800. The vertical bar slot assembly 400 may be configured to slidably receive a bar assembly 800 and which slidably interacts with the main body 810 of the bar assembly 800 to support the bar assembly 800 during loading, which may occur during use of the exercise device 10. The recess 415 cut from the slot insert 410 may support the bar assembly 800 (by interfacing with the protrusion 815) to prevent the bar assembly 800 from rotating during use. In some embodiments, the slot insert 410 may contain multiple recesses 415 cut from the side wall of the slot insert 410, allowing the bar assembly 800 to be inserted in a plurality of rotated positions and secure in the rotated position by the interaction of the protrusion 815 within the recess 415. For example and as shown in FIG. 11A, the slot insert 410 may include a recess 415 on opposite sides of the circular slot insert 410, such that each recess 415 may be separated by 180° about the slot insert 410 opening. In this example, the slot insert 410 may be configured to secure the bar assembly 800 in two positions, with each of the two positions corresponding to a respective recess 415.

In some embodiments, the keying geometry 420, 820 of both the slot insert 410 and the bar assembly 800 may include any number of different geometric shapes to accomplish the same result in the same way. Likewise, in some embodiments any number of vertical bar slot assemblies 400 may be located on the bench 15 in any plurality of positions, to provide the same functionality of the exercise device 10 in much the same manner.

Figure 7:
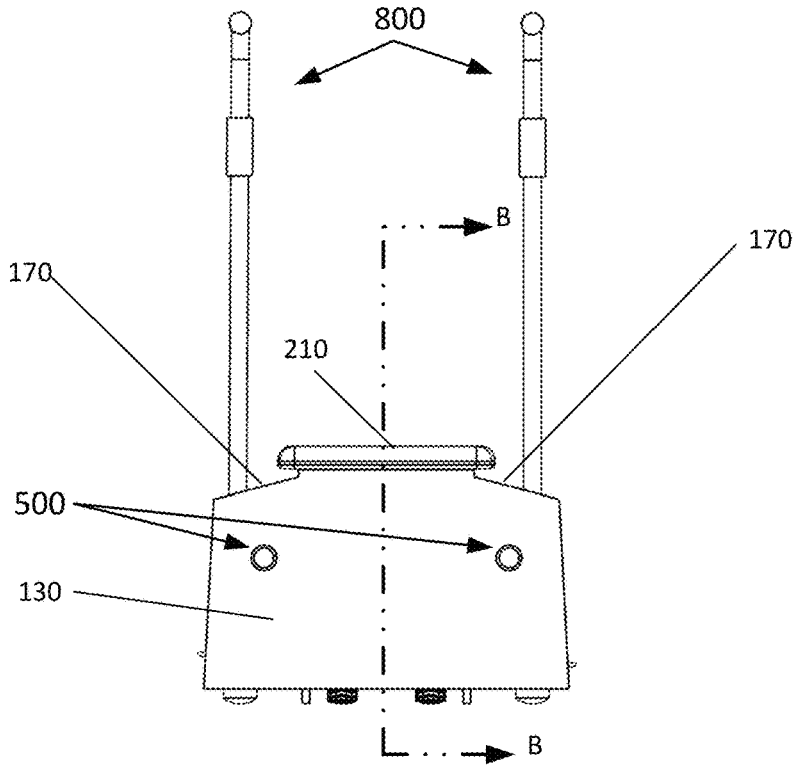
FIG. 7 is a rear view of the exercise device of FIG. 1.
Figure 13:
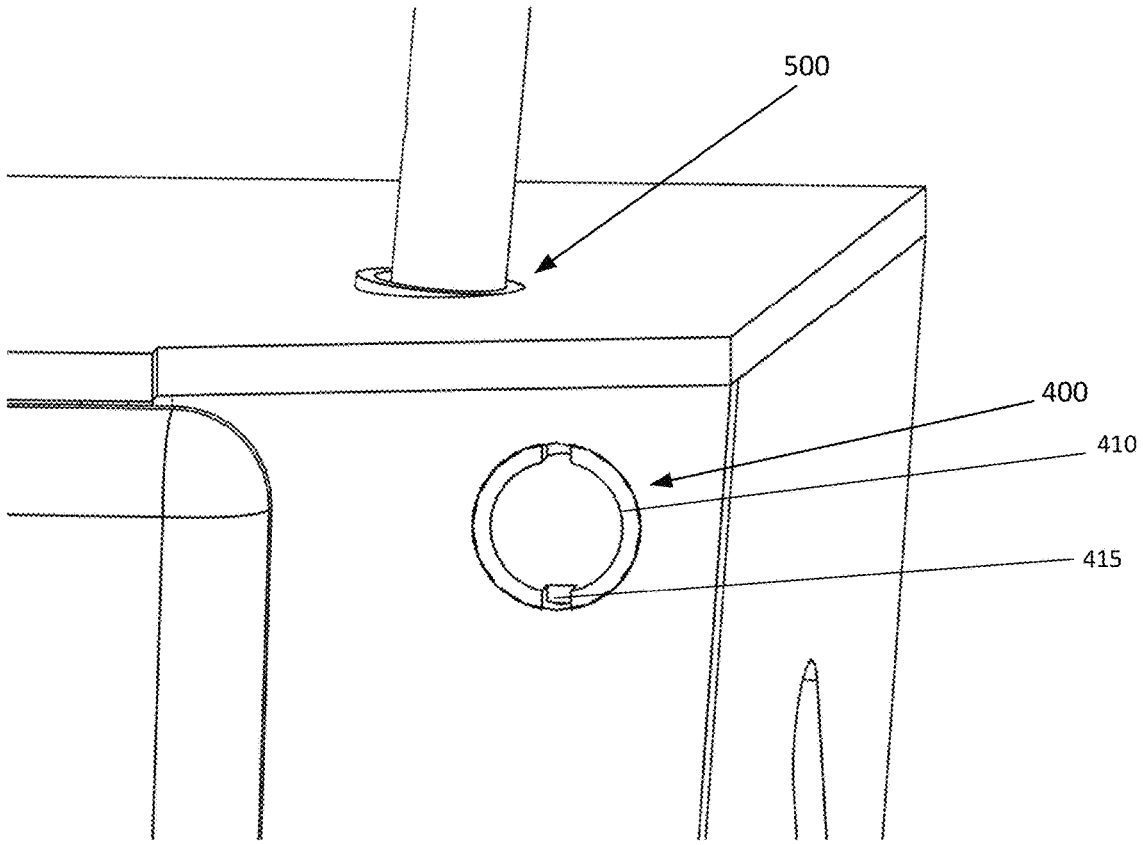
FIG. 13 is a detail view of the exercise device of FIG. 1.

In one embodiment, shown in FIG. 2, and in greater detail in FIGS. 10A-10B and 14A-14B, the bench 15 may include at least one horizontal bar slot assembly 500. In some embodiments, the bench 15 may include a pair of horizontal bar slot assemblies 500 that are positioned on opposite (and mirrored) positions, relative to an axis defined by a length of the bench. The horizontal bar slot assembly may include a slot insert 510, a keying geometry 520, and a lock pin 530. The horizontal bar slot assembly 500 may be configured to slidably receive a bar assembly 800. The horizontal bar slot assembly 500 may be located on a side surface 130 of the bench 15. In the embodiment shown in FIG. 2 and in greater detail in FIGS. 7 and 13, the bench 15 may include a set of two horizontal bar slot assemblies 500. In the embodiment shown, the slot insert 510 of the horizontal bar slot assembly 500 may extend inside of the bench 15. In some embodiments, the horizontal bar slot assemblies 500 may extend out from the bench 15. Each horizontal bar slot assembly 500 may be positioned substantially horizontal to the bottom surface 110 of the bench 15. In some embodiments, bar slot assemblies may be positioned at any plurality of angles with respect to the bottom surface 110 of the bench 15.

Each horizontal bar slot assembly 500 may include a slot insert 510 that may be fastened to the bench 15. The slot insert 510 may include side walls which together make up the keying geometry 520 of the horizontal bar slot assembly 500, and which slidably interacts with the keying geometry 820 of the bar assembly 800 to support the bar assembly 800 during loading which may occur during use of the exercise device 10. The slot insert 510 may be made from a metal, composite, wood, or other material that may be extruded as a tube stock, machined, molded, forged, or otherwise manufactured, and may be fastened to the bench 15 by mechanical means to support the bar assembly 800 when inserted into the bench 15. The slot insert 510 may be press fit into the bench 15, or in some embodiments fastened to the inside of the bench 15 or on the surface of the bench 15 using mechanical fastening methods. The slot insert 510 may be an independent component or may, in some embodiments, be integral to the bench 15 by molding, casting, or otherwise manufacturing the slot insert 510 as one piece with the bench 15. The slot insert 510 may be configured to slidably receive a bar assembly 800.

As shown in one embodiment, in FIGS. 14A-14B, the slot insert 510 may further include side walls which together make up a keying geometry 520. The keying geometry 520 may be configured to horizontally and slidably receive the bar assembly 800. The bottom of the slot insert 510 may support the bar assembly 800 and prevents the bar assembly from moving further into the bench 15, and the keying geometry 520 of the slot insert 510 may constrain the motion of the bar assembly 800 from side-to-side movements and may prevent any rotation of the bar assembly 800. The slot insert 510 may contain many side walls that make up the keying geometry 520, so that the keying geometry 520 may accept the bar assembly 800 in a plurality of rotated positions of the grip segment 840. The keying geometry 520 may further be configured to prevent rotation of the bar assembly 800 when installed in the slot insert 510. In the embodiment shown in FIGS. 14A-14B the keying geometry 520 may include one square shape, such that the keying geometry 820 of the bar assembly 800 may fit into the keying geometry 520 of the slot insert 510 of the horizontal bar slot assembly 500 at four unique positions. In some embodiments, different keying geometry for the interface between the bar assembly 800 and the horizontal bar slot assembly 500 may be used, to accomplish the same result of adjustability of the bar assembly 800, in the same way and functionality.

In some embodiments, such as the one shown in FIGS. 10A-10B, the horizontal bar slot assembly 500 may include a slot insert 510 that is substantially circular in profile. The inner circular wall of the slot insert 510 may be configured to slidably receive the main body 810 of the bar assembly 800. The slot insert 510 may include a recess 515 cut out from the slot insert 510, the recess 515 configured to receive a protrusion 815 from the main body 810 of the bar assembly 800. The horizontal bar slot assembly 500 may be configured to slidably receive a bar assembly 800 and which slidably interacts with the main body 810 of the bar assembly 800 to support the bar assembly 800 during loading which may occur during use of the exercise device 10. The recess 515 cut from the slot insert 510 configured to receive the protrusion 815 from the bar assembly 800 may support the bar assembly 800 to prevent the bar assembly 800 from rotation during use. In some embodiments, the slot insert 510 contains many recesses cut from the side wall of the slot insert 510, allowing the protrusion 815 of the bar assembly 800 to be inserted in a plurality of rotated positions.

In some embodiments, the keying geometry 520, 820 of both the slot insert 510 and the bar assembly 800 may include any number of different geometric shapes to accomplish the same result in the same way. Likewise, in some embodiments, any number of horizontal bar slot assemblies 500 may be located on the bench 15 in any plurality of positions, to provide the same functionality of the exercise device 10 in much the same manner.

As shown in one embodiment in FIGS. 14A-14B, the horizontal bar slot assembly 500 may further include a lock pin 530. The lock pin 530 may be fastened to the slot insert 510 and may contain geometry that protrudes into the slot insert 510 of the horizontal bar slot assembly 500. The lock pin 530 may be retained in the engaged position by an internal spring and may include a loop connected to the pin configured to be pulled back to disengage the lock. The protruding geometry of the lock pin 530 may correspond to and interact with the locking geometry 830 of the bar assembly 800, such that the locking geometry 830 of the bar assembly 800 captures the lock pin 530 of the horizontal bar slot assembly 500 when the lock pin 530 is engaged.

In some embodiments, such as the one shown in FIG. 10A-10B, the bar assembly 800 includes a protrusion 815 that may be configured to be biased outwards from the main body 810 of the bar assembly 800 by an elastic member 817 located inside of the main body 810 of the bar assembly 800. The horizontal slot assembly 500 may contain a recess 515 cut from the side wall of the slot insert 510, and the recess 515 cut from the slot insert 510 may be configured to receive the protrusion 815 of the bar assembly 800. The protrusion 815 may be connected to the elastic member 817 such that the elastic member 817 biases the protrusion 815 outward from the main body 810 of the bar assembly 800 to engage with the recess 515 of the slot insert 510 and prevents the bar assembly 800 from movement outward from the horizontal bar slot 500. The elastic member 817 may be configured to enable movement of the protrusion 815 when the elastic member 817 is compressed or otherwise manipulated. As such, a user may depress the protrusion 815 by interacting with either the protrusion 815 or the unlock button 814, which may compress or otherwise manipulate the elastic member 817, allowing the protrusion 815 to move to a position inside of the main body 810 of the bar assembly 800 which therefore would enable the main body 810 to move, pivot, rotate, and slide out from the horizontal bar slot assembly 500.

Figure 8A:
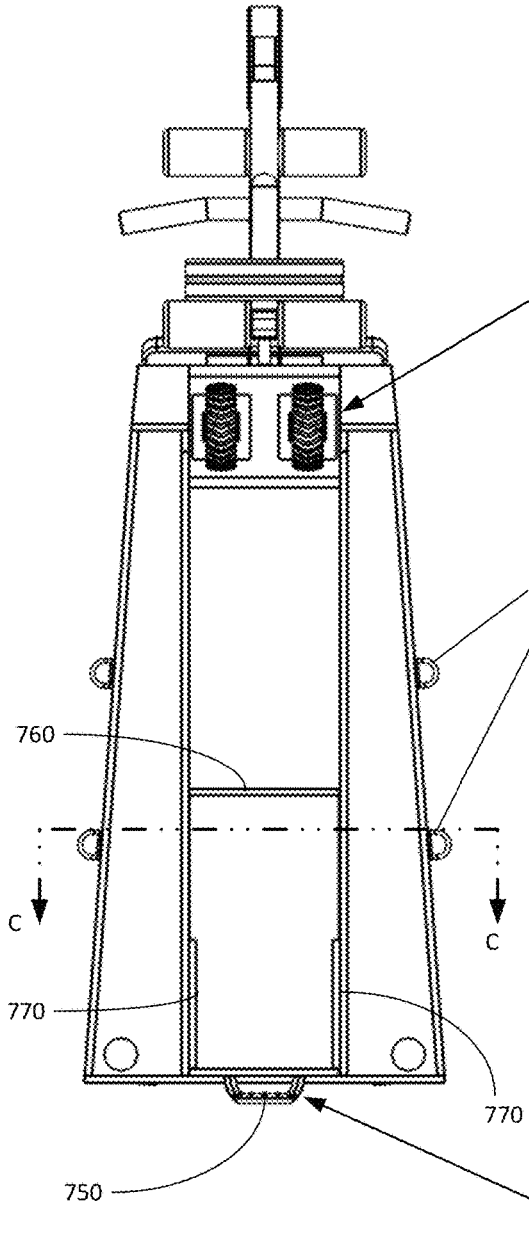
FIG. 8A is a bottom view of the exercise device of FIG. 1 in a first configuration.
Figure 8B:
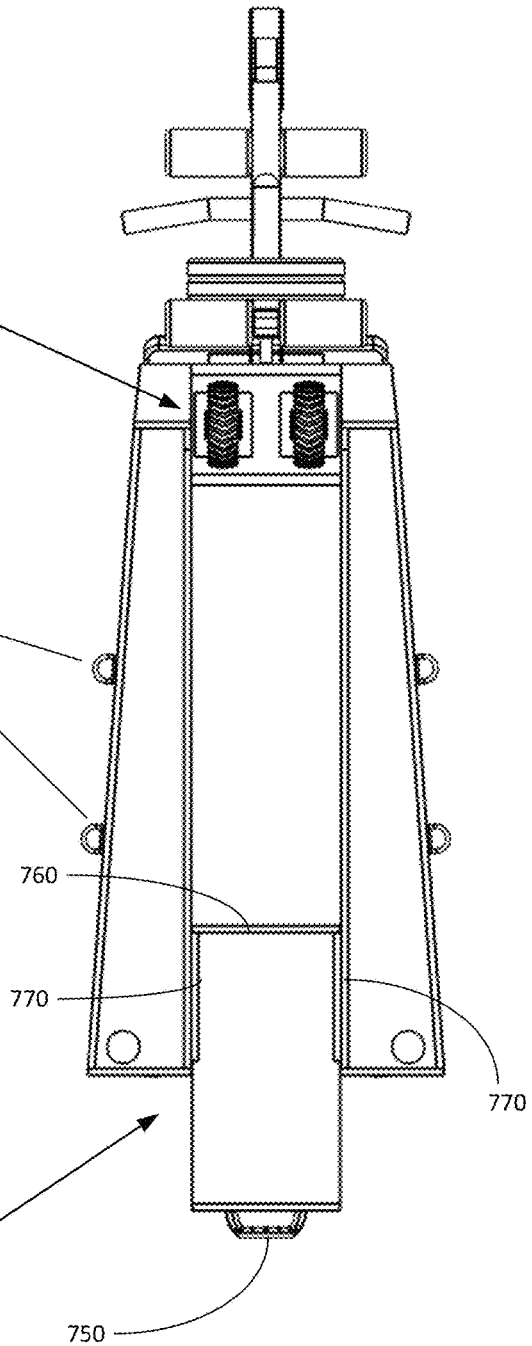
FIG. 8B is a bottom view of the exercise device of FIG. 1 in a second configuration.
Figure 9:
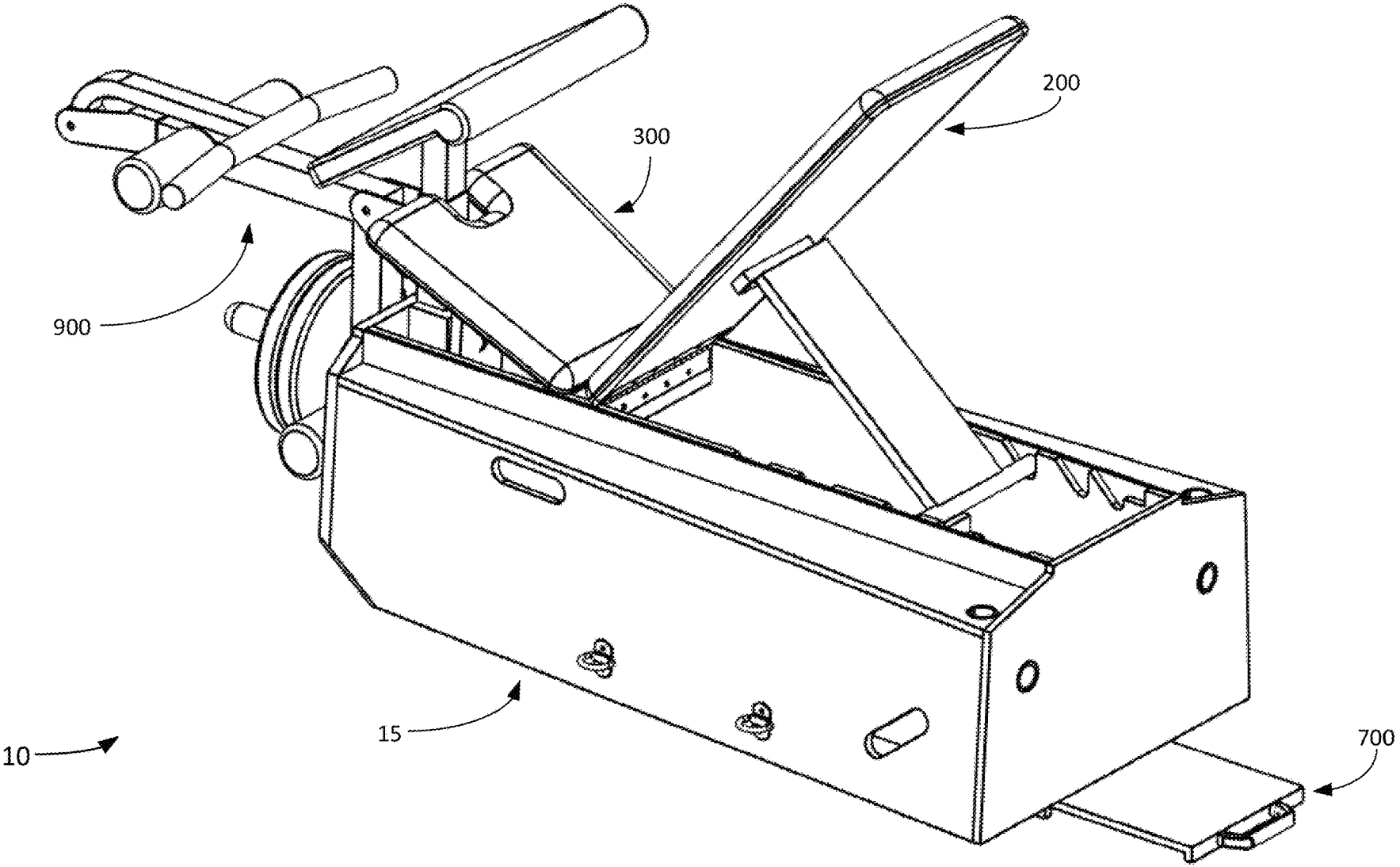
FIG. 9 is a rear isometric view of the exercise device of FIG. 1.
Figure 15:
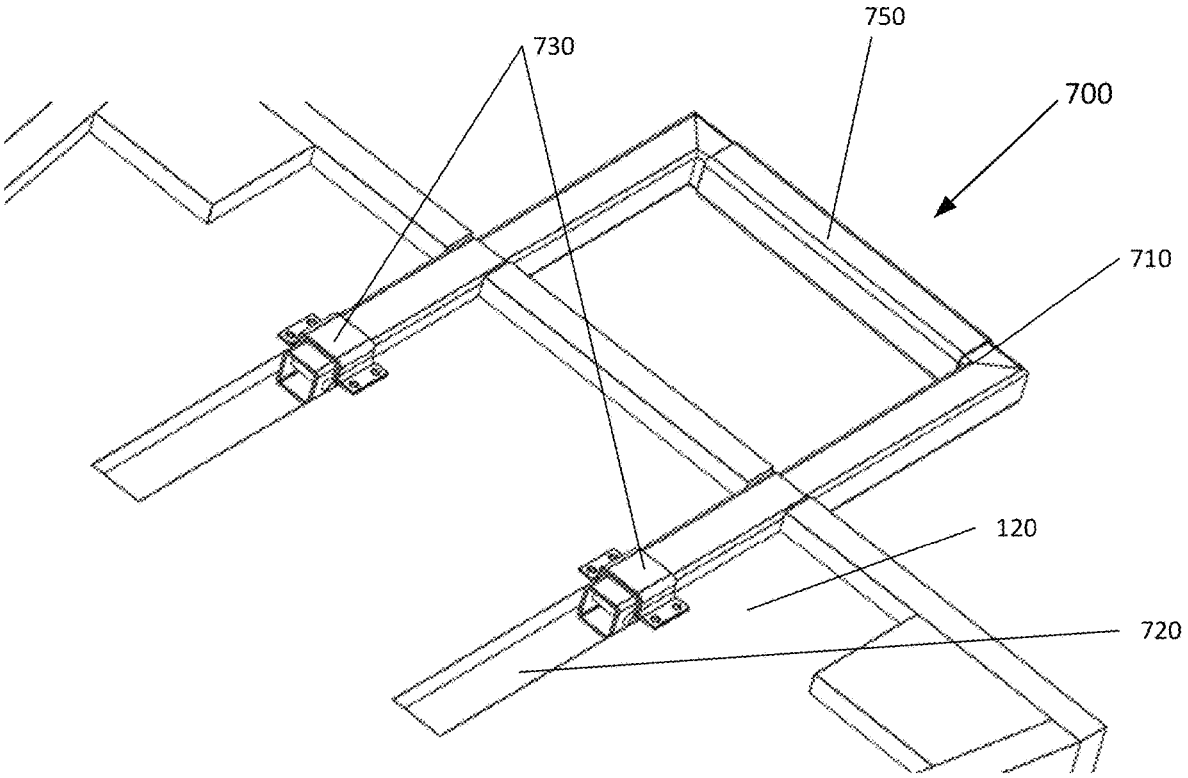
FIG. 15 is a detail view of an anti-tilt assembly of the exercise device of FIG. 1.

In one embodiment, shown in FIGS. 8A-B and FIG. 15, the bench 15 may further include an anti-tilt (or counterweight) assembly 700 configured to act as a counterweight for the bench. In some embodiments, the anti-tilt assembly 700 may include an anti-tilt bar 710, at least one channel 720, mounting brackets 730, and a grip surface 750 on the anti-tilt bar 710. In the embodiment shown in FIG. 15, the anti-tilt bar 710 may be made from an extruded square tube stock and may further include a plurality of pieces of square tube stock that are mechanically fastened together via screws, welding, etc. The anti-tilt bar 710 may be made from metal, wood, composite, or any other material and accomplish the same result by functioning in the same way. The anti-tilt bar 710 may be slidably fastened to the bench 15 by securing at least one channel 720 to the bench bottom surface 110 by mechanical or other mounting methods (e.g., welding the channel 720 to the bench bottom surface 110, using adhesive to fasten the channel 720 to the bench bottom surface 110, or using fasteners to secure the channel 720 to the bottom of the bench). In the embodiment shown in FIG. 15, two channels 720 may be mounted to the bench bottom surface 110 of the bench 15 by securing mounting brackets 730 over the channels 720 and fastening them by mechanical means to the bench 15. The anti-tilt bar 710 may then be slidably inserted into the at least one channel 720, which may then constrain the motion of the anti-tilt bar 710 and may prevent the anti-tilt bar 710 from movement except that movement which is in to and extending out from the bench 15. The anti-tilt bar 710 may then be slidably extended outwards from the bench 15 and may provide additional surface area to the bench bottom surface 110 which may prevent the bench 15 from tipping over or rotating when a user may use the bar assemblies 800 in either the vertically or horizontally inserted orientation.

In the embodiment shown in FIGS. 8A-B, the anti-tilt bar 710 may slide within channels defined by ridges 770 on either side of the anti-tilt bar 710. A functional length of the anti-tilt bar 710 may be defined by a protrusion 760 on an end of the anti-tilt bar 710 opposite of the grip portion 750, as the protrusion 760 interfaces with the ridges 770 to prevent further lateral movement of the anti-tilt bar.

In some embodiments, the anti-tilt bar 710 may be otherwise adjustably mounted to the bench 15 by a pivoting bracket, hinge, or other adjustable component. Likewise, in some embodiments the anti-tilt bar 710 may be integral to the overall structure of the bench 15, or otherwise rigidly and non-adjustably attached to the bench 15 by mechanical means. The anti-tilt bar 710 may include a grip 750, that may be made from rubber, plastic, or other composite material, and may be molded over or otherwise placed over the surface of the anti-tilt bar 710. In some embodiments the anti-tilt bar 710 may not contain a grip 750.

In some embodiments, the anti-tilt assembly 700 may include a secondary seat rest and back rest, slidably attached to the bench 15. In some embodiments, the anti-tilt assembly 700 may be slidably attached to the bench 15 and may include a second seat rest and second back rest, the second back rest pivotally attached to the second seat rest, and the seat rest may be fastened to the anti-tilt bar 710 by mechanical means. In this embodiment, the anti-tilt assembly 700 may be configured to be slidably stored inside the bench 15 when not in use. In some embodiments, the anti-tilt assembly 700 including a second seat rest and second back rest may be configured to be pivotally stored inside the bench 15, or detachable and capable of being stored inside the bench 15.

Figure 17:
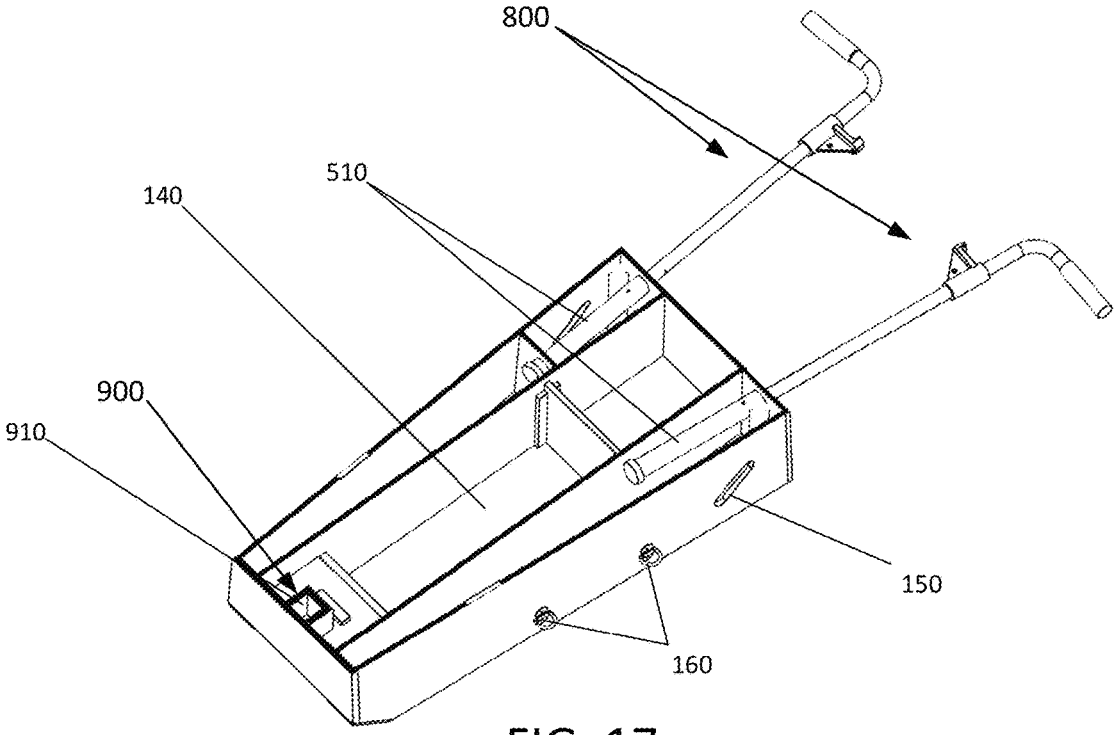
FIG. 17 is a section view of the exercise device of FIG. 1 taken along line A-A of FIG. 3.
Figure 18:
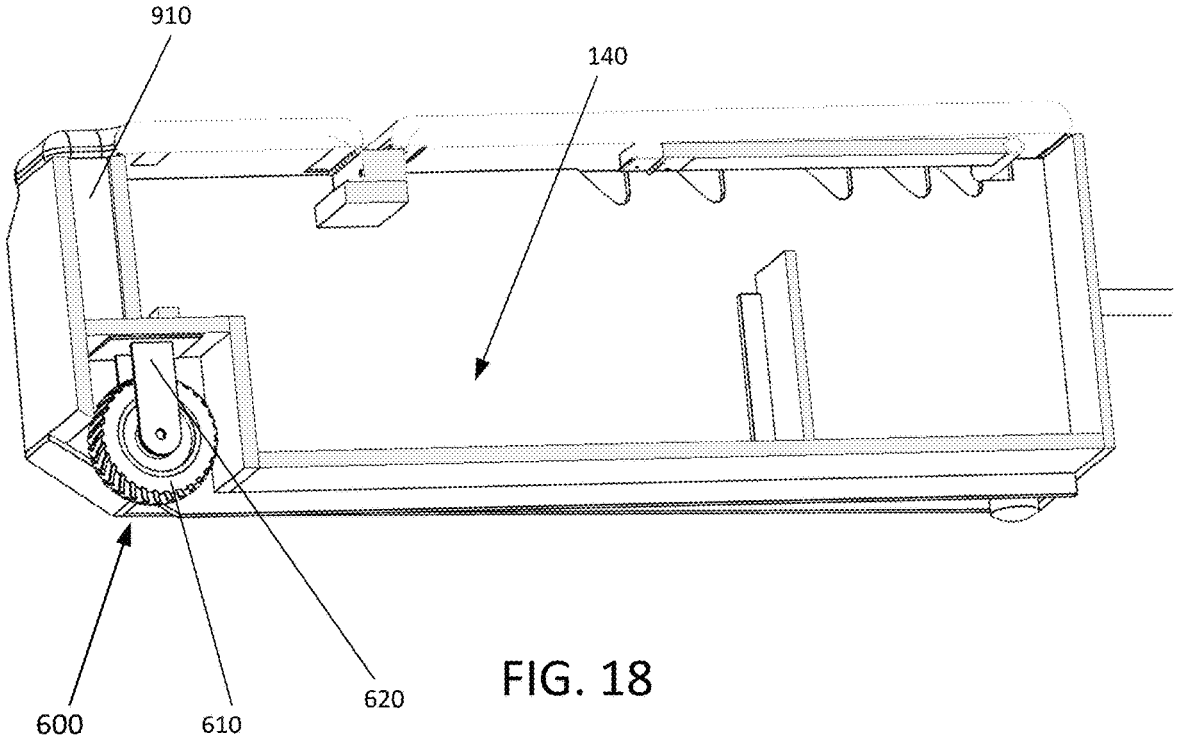
FIG. 18 is a cross-section view of the exercise device of FIG. 1 taken along line B-B of FIG. 7.
Figure 19:
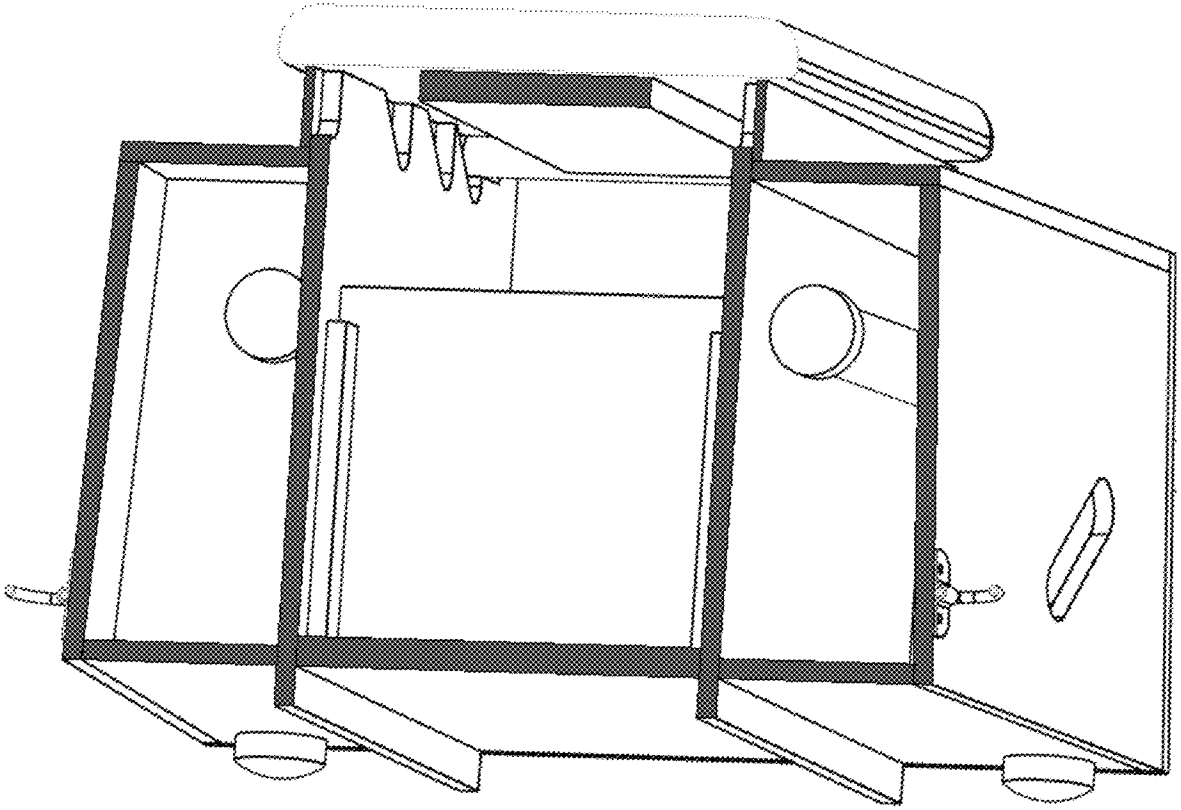
FIG. 19 is a section view of the exercise device of FIG. 1 taken along line C-C of FIG. 8A.

In one embodiment, shown in FIGS. 17-19, the bench 15 may include an internal storage space 140 formed from the internal surfaces of the bench top surface 120, bottom surface 110, and side surfaces 130. In some embodiments, the bench 15 may not include an internal storage space.

In some embodiments of the exercise device 10, the bench 15 may further include at least one handle 150. The handles 150, as shown in FIGS. 1 and 2, may be located on the side surfaces 130 of the bench 15, and may be manufactured by cutting material away from the side surfaces 130 of the bench 15. In some embodiments, the handles 15 may be hardware components that may be fastened to the side surfaces 130 of the bench 15. In some embodiments, the top surface 120 and bottom surface 110 of the bench may also include handles 150. The handles 150 may be configured to provide an opening or dedicated area for receiving a user's hand(s) to grasp and otherwise hold the bench 15.

Figure 3:
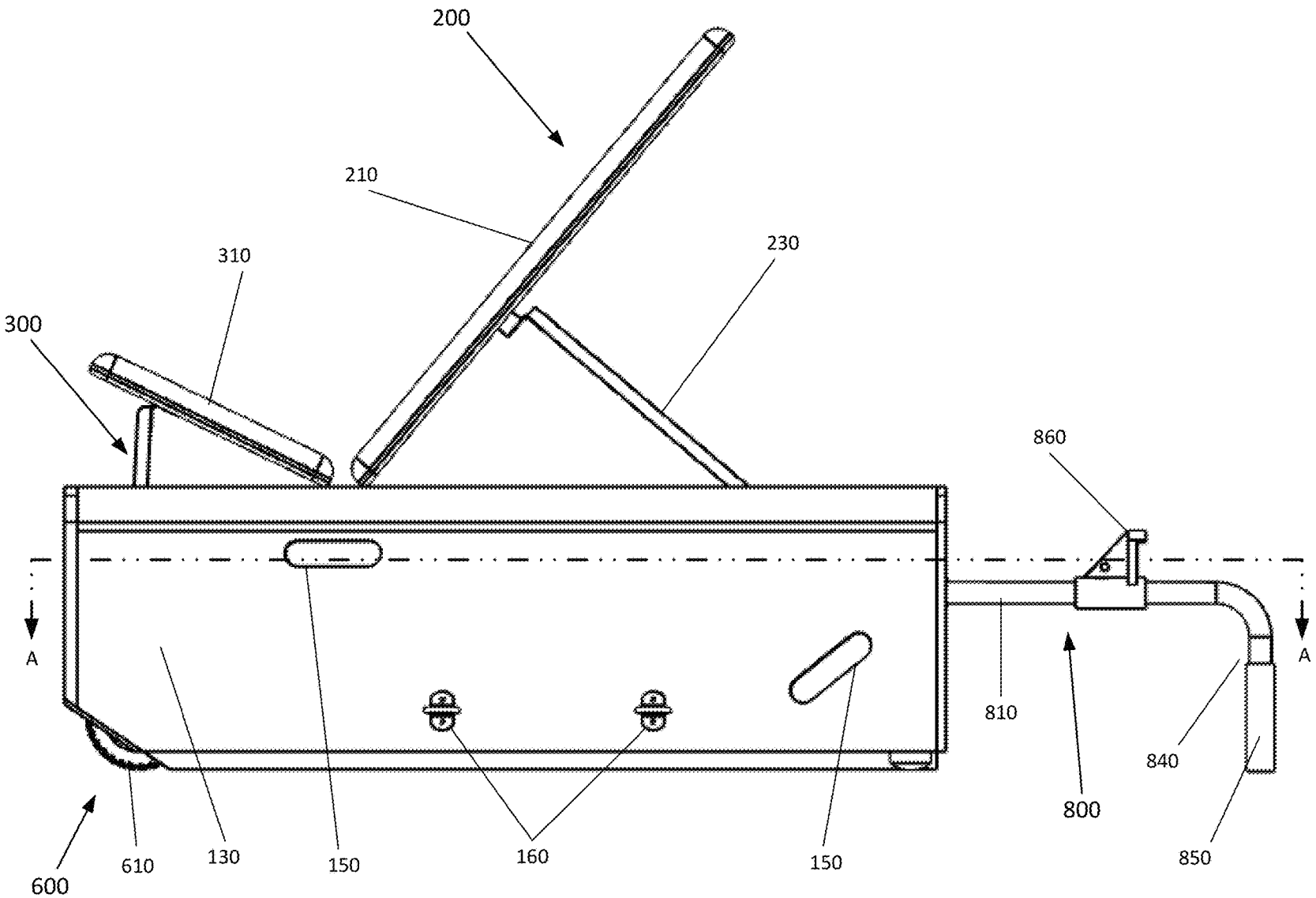
FIG. 3 is a right side view of the exercise device of FIG. 1.

In one embodiment of the exercise device 10, shown in FIGS. 1 and 3, the bench may further include resistance band attachment points 160 located on the side surfaces 130 of the bench 15. The resistance band attachment points 160 may be made integral to the side surfaces 130 of the bench 15 by removing material from the side surfaces 130 to form a hook-like structure which may retain a portion of a resistance band, or in some embodiments, the resistance band attachment points 160 may be hardware components that may be fastened on to the side surfaces 130 of the bench 15. The resistance band attachment points 160 may include hardware that may include a hook-like structure, and may be made from a metal, wood, composite, or other material, and may be fastened to the side surface 130 of the bench 15 by mechanical methods. In one embodiment, the bench 15 contains resistance band attachment points along the entire perimeter of side surfaces 130. In some embodiments, the top surface 120 and bottom surface 110 of the bench 15 may also include resistance band attachment points 160. Still in some embodiments, the bench 15 may not include any resistance band attachment points, but still operates primarily in the same manner. The attachment points 160 may be hooks, loops, or other similarly-shaped protrusions, and may be configured to receive one or more resistance bands or other ropes, chains, etc. to secure the resistance bands to the exercise device 10.

Figure 6:
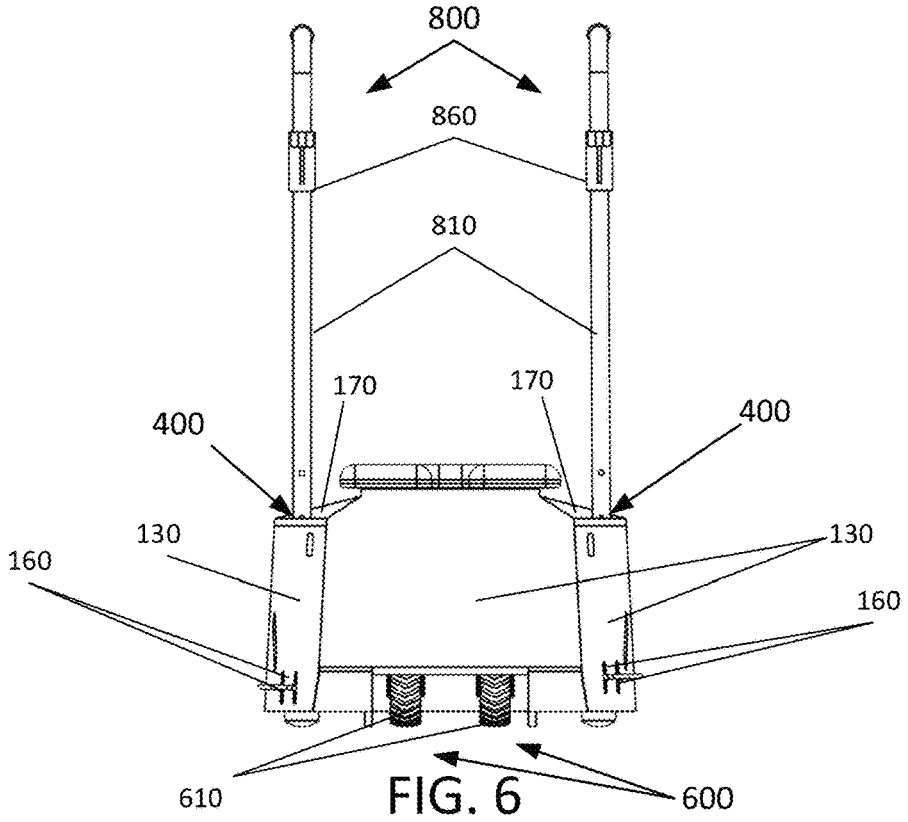
FIG. 6 is a front view of the exercise device of FIG. 1.

In one embodiment, shown in FIG. 6, the exercise device 10 may include flared out sides 170 configured to receive the vertical bar slot assemblies 400 while also not interfering with the adjustability and dimensions of the back rest assembly 200. The flared out sides 170 may be constructed in much the same way as the bench 15 main structure may be constructed, by fastening a plurality of substantially planar surfaces together at a plurality of angles to form portions of the bench 15 that may be wider than the bench top surface 120 but may not extend to the entire top surface 120 and may not span the entire distance between the top surface 120 and bottom surface 110 of the bench 15. As such, the flared out sides 170 may enable portions of the bottom surface 110 to have a greater width than the top surface 120. For example, the portion of the bottom surface 110 towards the end of the bench 15 with the vertical bar assemblies slot 400 may have a greater width in order to accommodate spacing the vertical bar slot assemblies 400 to shoulder distance (relative to an average user), while the width of the portion of the bottom surface 110 opposite the vertical bar assemblies slot 400 may be equal to that of the top surface 120 to allow a user to straddle or stand over the bench 15 at that portion.

Shown in FIG. 1, in some embodiments, the bench top surface 120 of the bench 15 may further include a back rest adjustment assembly 200, and a seat rest adjustment assembly 300. Shown in more detail in FIG. 5A, the back rest adjustment assembly 200 may include a back rest 210, an internal notch bracket 220, a seat adjustment bracket 230, at least one clamp 240, and a hinge 260. The back rest 210 may be positioned towards a relative front of the bench 15, and may be made from a metal, wood, composite, or other material, and the back rest may further include a foam, cushion or other like padding material secured on the outer facing surface of the back rest 210 which the user may rest against during exercise. The back rest 210 may be pivotally mounted to the bench 15 or bench top surface 120 by fastening the back rest 210 to a first end of a hinge 260 and fastening a second end of the hinge 260 to the bench 15 or bench top surface 120. The back rest adjustment assembly 200 may further include an adjustment bracket 230 that may be pivotally mounted to the back rest 210 by fastening clamps 240 to the back rest 210, the clamps 240 pivotally capturing a portion of the adjustment bracket 230 to the back of the back rest 210. The adjustment bracket 230, shown in FIG. 5A, may be constructed from tube stock or bar stock or other materials, and may be made from metal, wood, composite, or any other material to accomplish the same result by functioning in the same way. The adjustment bracket 230 may further include at least one prong 235 that may be configured to fit into a notch of a notch bracket 220 that is secured to the bench 15.

Figure 5A:
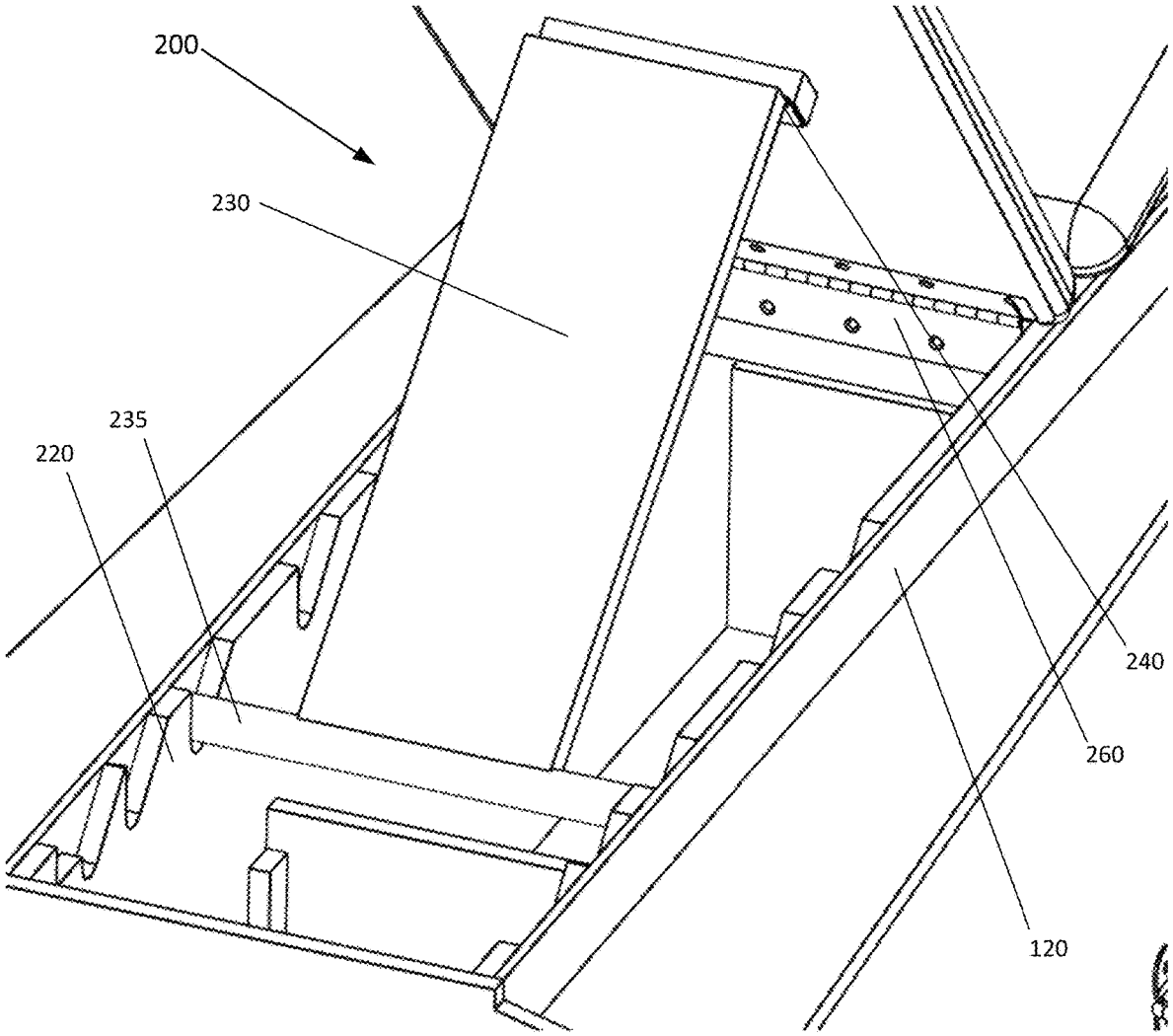
FIG. 5A is a detail view of a back rest adjustment assembly of the exercise device of FIG. 1.

In some embodiments, such as the one shown in FIG. 5A, the adjustment bracket 230 may be constructed from a substantially planar piece of material, such as wood, metal, composite, or other material, and be pivotally attached to the back rest 210 by fastening a first end of a hinge 260 to the adjustment bracket 230 and fastening a second end of the hinge 260 to the back rest 210. A prong 235 may be mechanically fastened to the adjustment bracket 230, the ends of the prong 235 configured to fit into a notch of a notch bracket 220 that is secured to the bench 15.

The back rest adjustment assembly 200 may further include a notch bracket 220. In one embodiment, the notch bracket 220 may be mounted or fastened to the bench 15 by mechanical means, however in some embodiments the notch bracket 220 may be integral to the bench 15. The notch bracket 220 may include a series of notches or cutouts that may be configured to receive at least one prong 235 of the adjustment bracket 230 that may be pivotally mounted to the back rest 210. The back rest 210 may be adjusted by moving the adjustment bracket 230 to various positions, or notches, on the notch bracket 220, which may adjust an angle of the back rest 210 relative to the bench top surface 120. For example, moving the adjustment bracket 230 from a notch relatively close to the hinge 260 to a notch relatively farther from the hinge 260 may cause the angle formed by the back rest 210 with the bench top surface 120 to decrease.

Figure 5B:
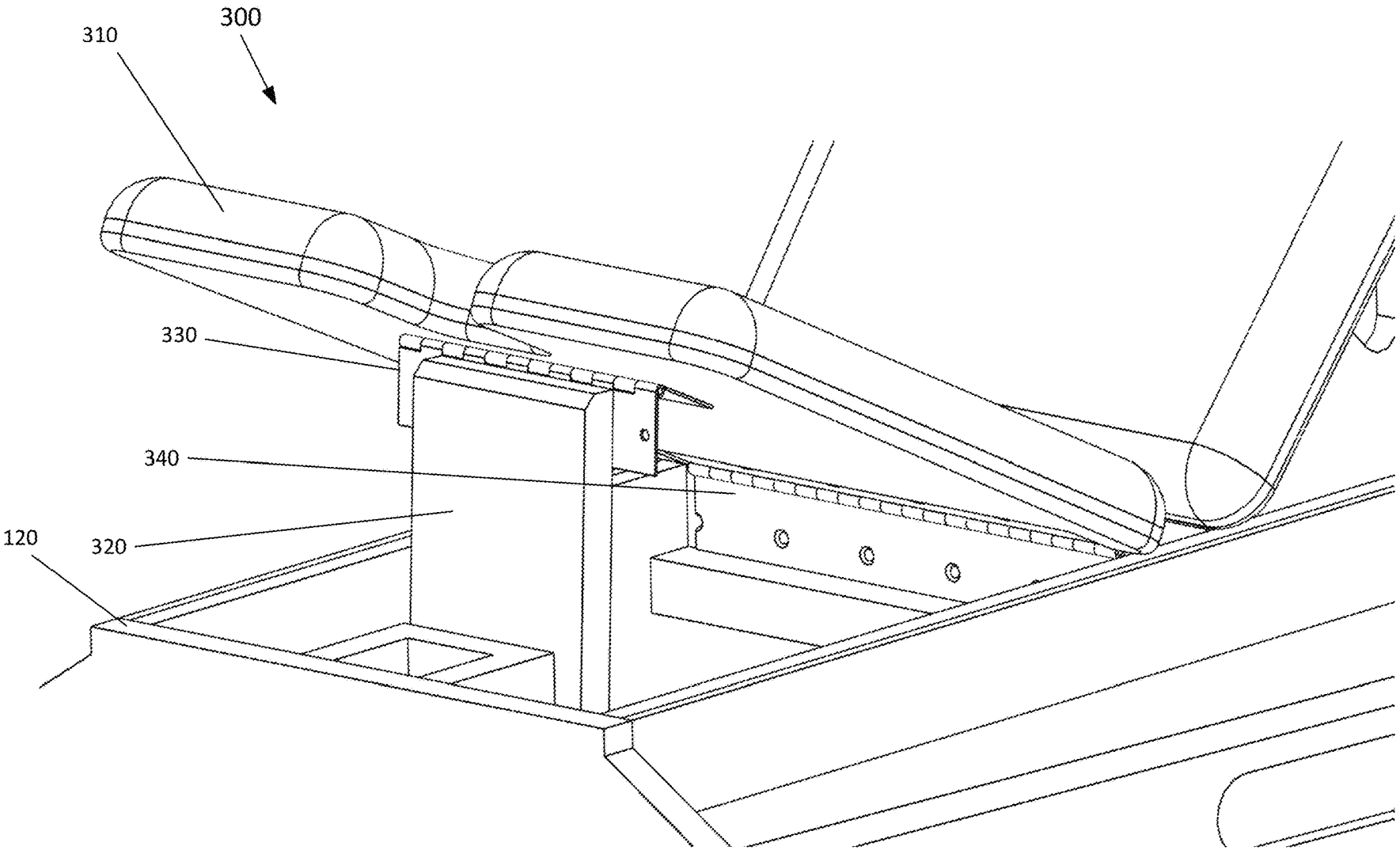
FIG. 5B is a is a detail view of a seat rest adjustment assembly of the exercise device of FIG. 1.

In some embodiments, such as the one shown in FIG. 5B, the seat rest 310 may be positioned towards a relative rear of the bench 15, and may also have an adjustable seat rest assembly 300 which allows for adjustment of the seat rest 310 position, comprising the same components and operating in the same way as the back rest adjustment assembly 200. As such, the adjustable seat rest assembly 300 may include may include an internal notch bracket 320, a seat adjustment bracket 330, and a hinge 340. In one embodiment, both the seat rest 310 and the back rest 210 have adjustable assemblies. In a different embodiment, only the back rest 210 has a back rest adjustment assembly 200. In yet a different embodiment, only the seat rest 310 has an adjustable assembly.

In some embodiments, adjustment mechanisms other than an adjustment bracket 230 and notch bracket 220 may be used to adjust the back rest 210 and seat rest 310. In one embodiment, an inner sleeve may be connected to either the back rest 210 or the bench 15 and may contain position holes and an outer sleeve may be connected to the other of the back rest 210 or the bench 15 and may contain a spring pin, where the spring pin of the outer sleeve may align with a hole of the inner sleeve, the inner and outer sleeve lock together at a specified incline position of the back rest 210. In some embodiments, a hydraulically-supported adjustment mechanism may be used in the back rest adjustment assembly 200 or the seat rest adjustment assembly 300. For example, the adjustment bracket 230 may include a hydraulic component configured to adjust an effective length of the adjustment bracket 230 and, therefore, a relative position of the back rest 210. In these embodiments, the prong 235 and notch bracket 220 may be omitted. All adjustment mechanisms operate in substantially the same way to achieve the same result of adjusting the back rest 210 and the seat rest 310 at a plurality of incline or decline positions.

Figure 16:
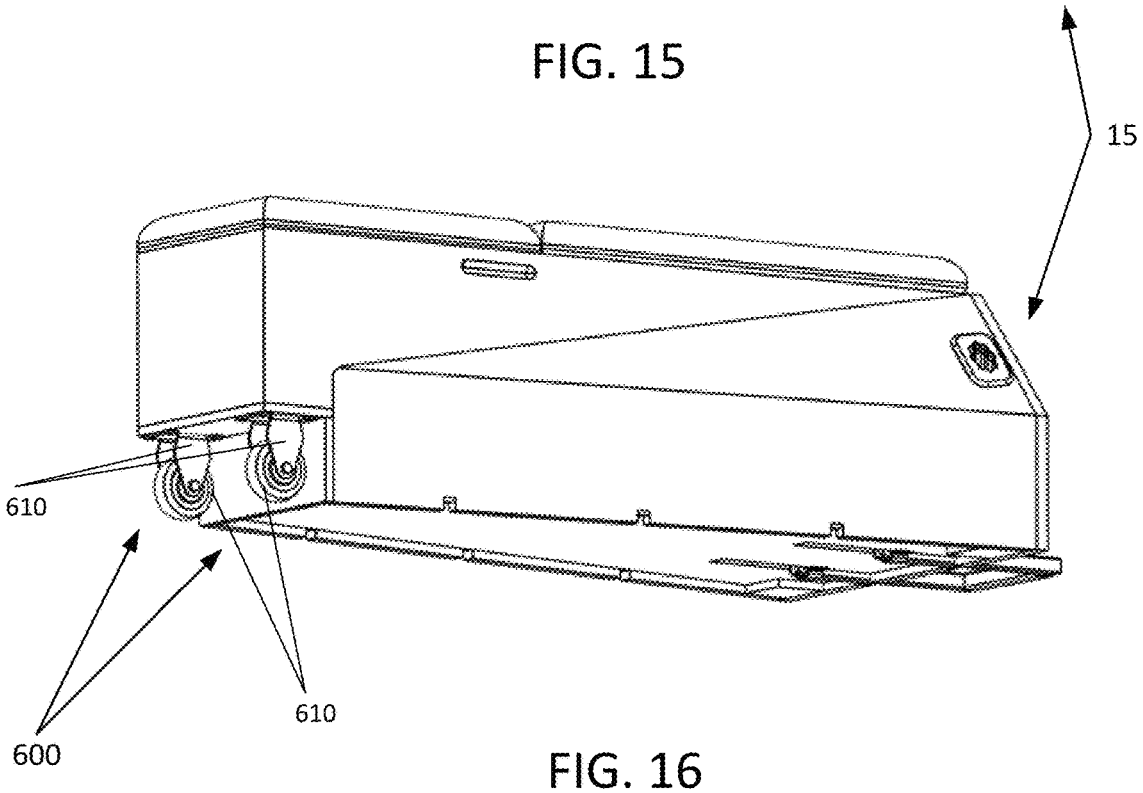
FIG. 16 is a perspective view of the exercise device of FIG. 1.

In some embodiments, the exercise device 10 may further include at least one wheel assembly 600 fastened to the bench 15. In the embodiment shown in FIG. 1, and shown in greater detail in FIG. 16, a wheel assembly 600 may include at least one wheel 610 and one mounting plate 620. The wheel 610 may include a standard mechanical wheel, and may be made from a rubber, composite, metal, wood, or other material to accomplish the same result by functioning in the same way. The wheel 610 may be fastened to the bench 15 at any one of the side surfaces 130 or in some embodiments at the bench bottom surface 120 by a mounting plate 620 that is pivotally and rotatably connected to the wheel 610 at one end, and mechanically fastened by mechanical means to the bench 15 at the other end. In one embodiment, the bench 15 may include a wheel assembly 600 that may only include one wheel 610 that may be free to roll and pivot, changing directions. In some embodiments, the bench 15 may include a wheel assembly 600 that may include two wheels 610 that may be free to roll and pivot, changing directions. In some embodiments, the wheels 610 may be fixed, and may only rotate, but not pivot, such that the wheel assembly 600 may be capable of forward and backward movement, but not side-to-side movement or pivoting.

In some embodiments, the bar assembly 800 may further include an extension attachment for the main body 810. The extension attachment may include two ends and may be configured to receive the keying geometry 820 of the bar assembly 800 on one end, and further configured to be slidably inserted into the vertical bar slot assembly 400 at the second end.

Figure 20:
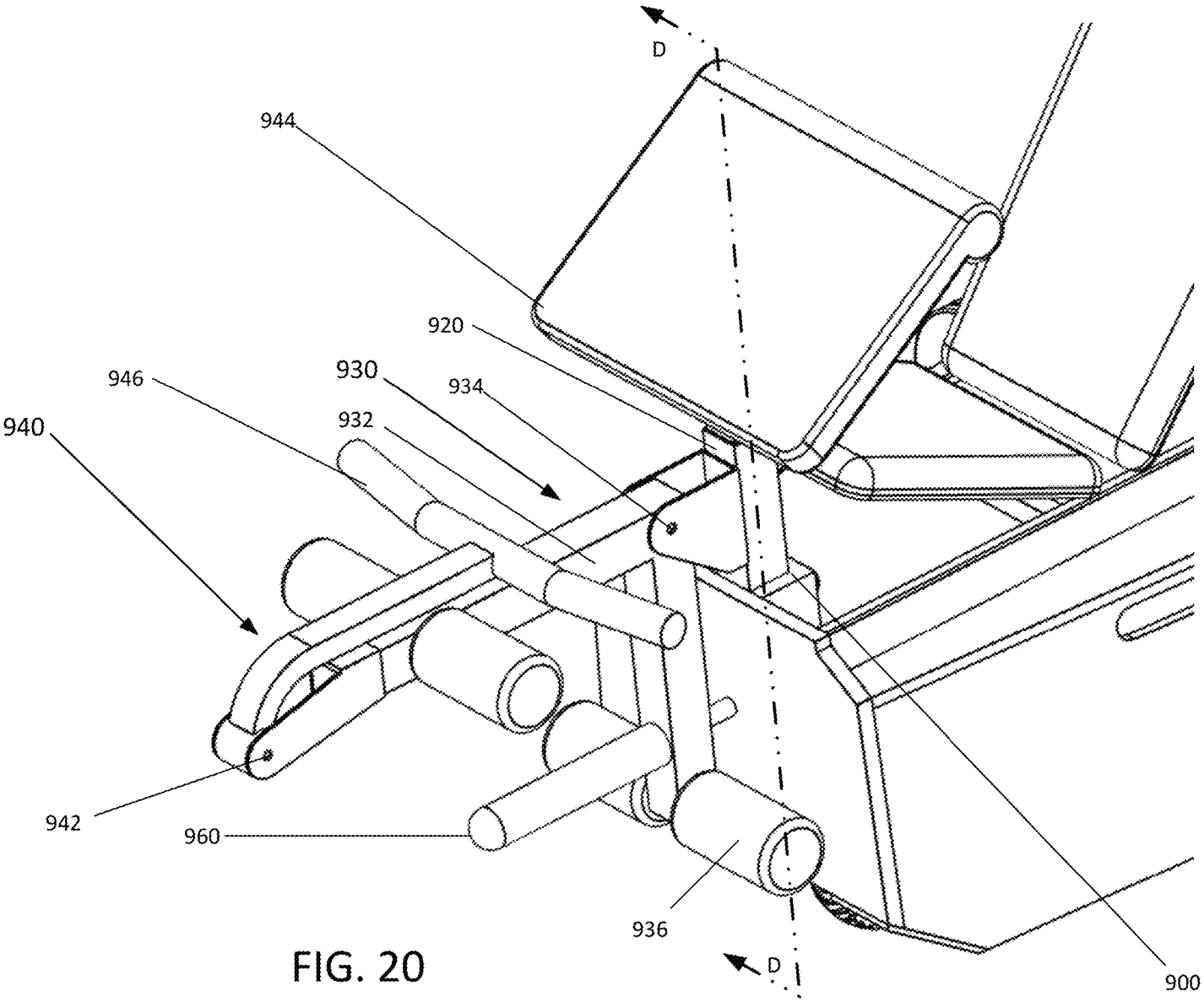
FIG. 20 is a perspective view of a leg curl and arm curl attachment for the exercise device of FIG. 1.
Figure 21:
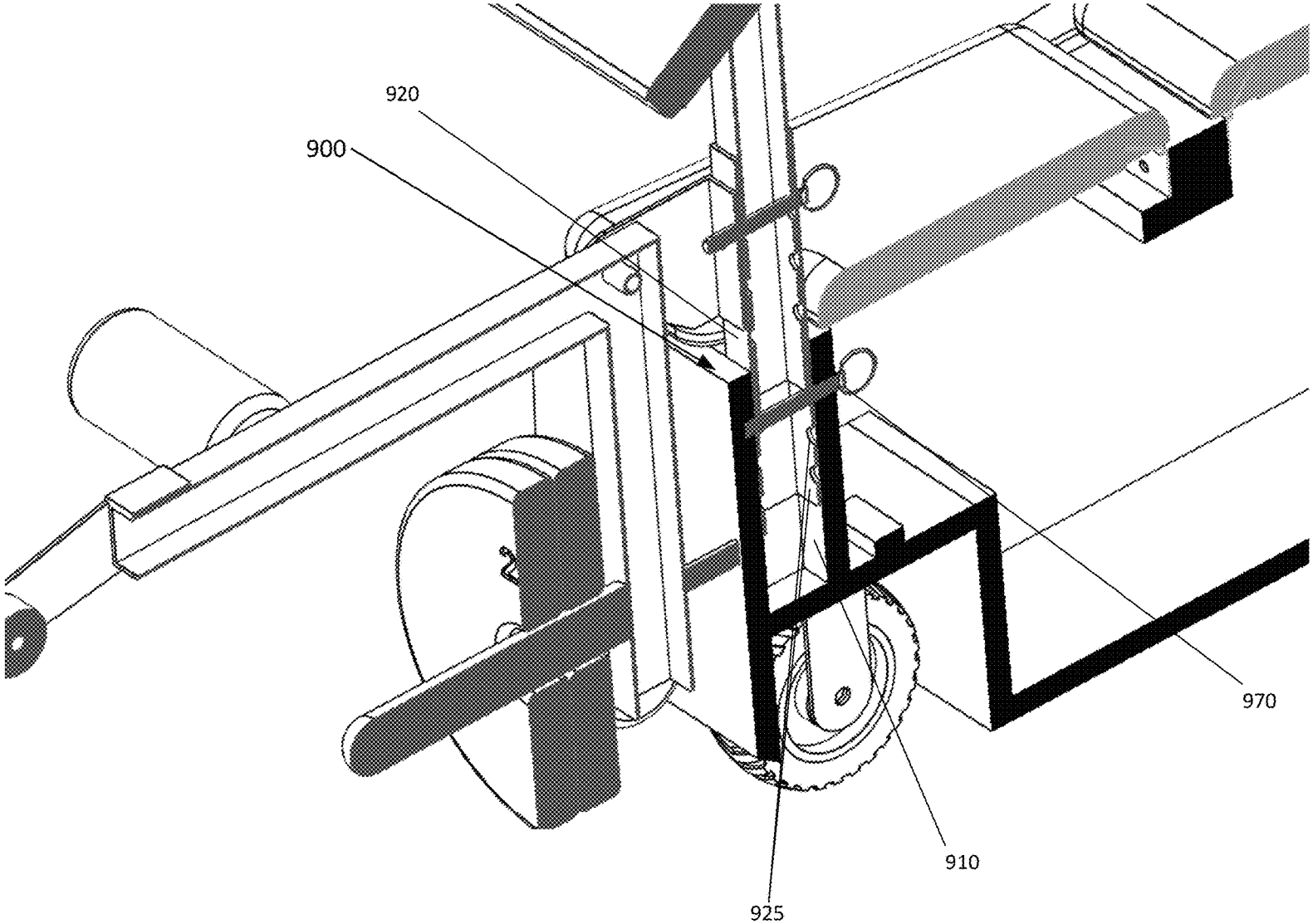
FIG. 21 is a perspective view and a section view of a leg curl and arm curl attachment for the exercise device of FIG. 1 taken along line D-D of FIG. 20.
Figure 22:
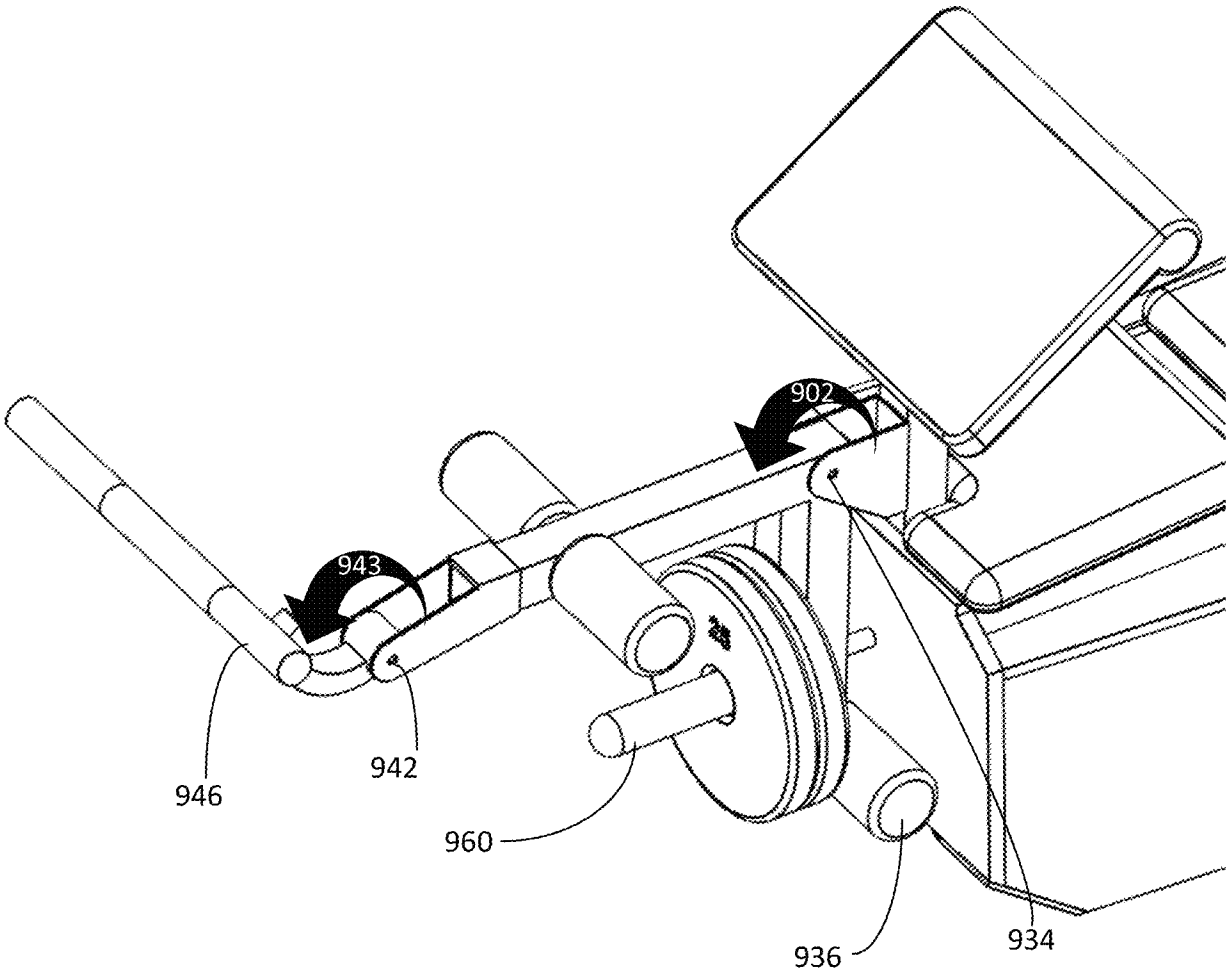
FIG. 22 is a detail view of the leg curl and arm curl attachment of FIG. 20.

In some embodiments, such as the one shown in FIGS. 20-21, the bench 15 may further include an attachment module 900 for a leg curl and arm curl attachment 930, 940. The attachment module 900 may be integral to the bench 15 itself or may be fastened to the bench 15 using mechanical methods. In one embodiment, the attachment module 900 may include a mounting plate for mounting the attachment module 900 to the bench 15. The attachment module 900 may further include a mounting sleeve 910 with a locking pin 970. The leg curl and arm curl attachment may include a corresponding mounting member 920 configured to interact with the mounting sleeve 910 of the attachment module 900. The mounting member 920 of the leg curl and arm curl attachment may include a plurality of holes 925 which interact with the locking pin 970 of the attachment module sleeve 910. In some embodiments, different attachments may be configured to mount to the attachment module 900.

In one embodiment shown in FIGS. 20-21, a leg curl attachment 930 includes a mounting member 920 with a plurality of holes 925 which interact with the locking pin 970 of the attachment module 900 mounting sleeve 910. In some embodiments, the leg curl and arm curl attachment may be pivotally or rotatably mounted to the attachment module 900 through a single pin attachment. In some embodiments, the leg curl attachment includes a leg pivoting bar 932 that is pivotally connected to the leg curl attachment 930 mounting member 920 by a pinned connection 934, hinge connection, or other mechanical means. In some embodiments the leg curl attachment 930 may include at least one leg pad 936 configured to support at least one of a leg, shin, or calf of a user. The leg curl and arm curl attachment may further include at least one resistance band attachment point and at least one weight attachment point 960.

In some embodiments, the exercise device may include an arm curl attachment 940. In some embodiments, the arm curl attachment 940 may be configured to attach independently of the leg curl attachment 930. In some embodiments, the arm curl attachment 940 is configured to be integral to the leg curl attachment 930, where the arm curl attachment 940 is pivotally connected to the leg curl attachment 930 by a pin 942, fastener, or other mechanical means, such that the arm curl att The arm curl attachment 940 may include at least one pad 944 for supporting at least one arm of a user and may be configured to attach to the bench 15 in the same manner and with the same components as the leg curl attachment 930.

In some embodiments, a bench decline attachment may be configured to connect to the bench 15 in the same manner with the same components as the leg curl attachment or the bicep attachment. The bench decline attachment may be configured to raise the seat rest 310 portion of the bench 15 so that the seat rest 310 is higher off the ground than the back rest 210 portion of the bench 15.

In one aspect and embodiment, a user may exercise on the exercise device 10 with the back rest 210 and seat rest 310 in the fully reclined or flat position. The back rest 210 and seat rest 310 may lay flat on the top surface 120 of the bench 15. The user may lay down flat, facing upwards, across the seat rest 310 and back rest 210 to perform standard bench press exercises, or pushing movements of the upper body.

In other aspects and embodiments, a user may lay facing upwards on the exercise device 10 with the back rest 210 in an inclined position to perform an inclined bench exercise. The user may accomplish this by first raising the back rest 210 of the back rest adjustment assembly 200, then pivoting the adjustment bracket 230 that may be attached to the back rest 210 by the clamps 240 outward. The user may then place the adjustment bracket 230 into one notch located on the notch bracket 220 to fix the adjustment bracket 230 in place. In other aspects, the user may select a different notch in the notch bracket 220 to create a different incline angle of the back rest 210. In other aspects and embodiments, the user may also adjust the seat rest 310 during an incline bench exercise, wherein the exercise device 10 may further include an adjustable seat rest assembly with the same components as the back rest adjustment assembly 200.

In other aspects, the user may lay facing downwards on the inclined back rest 210 of the back rest adjustment assembly 200 to perform a seated rowing exercise, or a pulling movement of the upper body. In other aspects, the user may use the inclined or fully reclined back rest 210 and seat rest 310 in any plurality of orientations and inclined angles.

Shown in FIG. 4B, and in greater detail in FIGS. 12-13 and 14C-14D, in other aspects and embodiments, the user may remove at least one bar assembly 800 from the internal storage space 140 located inside of the bench 15. In some embodiments, the bench 15 may not include an internal storage space and the user may retrieve the bar assembly 800 from another location. The user then may take the bar assembly 800 and align the main body 810 of the bar assembly 800 to the vertical bar slot assembly 400. The user then may align the keying geometry of the bar assembly 800 with the keying geometry of the vertical bar slot assembly 400 in one orientation of the bar assembly 800, corresponding to one position of the grip segment 840 of the bar assembly 800 with respect to the bench 15. The user then may slide the bar assembly 800 down into the slot insert 410 of the vertical bar slot assembly 400, until the bar assembly 800 comes to rest against the bottom of the slot insert 410 or bench 15.

In the embodiment shown in FIG. 4B, the user may retrieve two bar assemblies 800 and insert one bar assembly 800 into each one of the two vertical bar slot assemblies 400 on the bench 15. The user then may grab the anti-tilt bar 710 by the grip portion 750 and slide the anti-tilt bar 710 outwards extending away from the bench 15. The anti-tilt bar 710, slidably fastened to the bench 15, may support the bench 15 and prevent it from tilting or tipping over during the user's subsequent exercises.

In some embodiments, such as the one shown in FIGS. 20-21, the user may attach the leg and arm curl attachments, 930, 940 to the bench by slidably inserting the mounting member 920 of the leg and arm curl attachments 930, 940 into the mounting sleeve 910 of the attachment module 900 of the bench 15 and securing the leg and arm curl attachment 930, 940 by inserting the locking pin 970 through the hole in the mounting sleeve 910 of the attachment module 900 of the bench 15, and through any one of the plurality of holes 925 in the mounting member 920 of the leg and arm curl attachment 930, 940. The user may then place weights on the weight attachment point 960 of the leg and arm curl attachment 930, 940 in order to counterbalance the weight of the bench 15 and prevent the bench 15 from tipping over during the user's subsequent exercises.

While the bar assembly or bar assemblies 800 may be installed in the vertical bar slot assemblies 400, the user may then perform various vertical exercises by holding on to the grip surface 850 of the grip segment 840 of the bar assembly 800 and utilizing the user's own body weight to perform exercise movements. In one aspect, a user may perform a pull up by positioning the user's body below the grip segment 840 of the bar assembly 800, gripping the gripping surface 850 of the grip segment 840 of the bar assembly 800, and pulling the user's body weight until the user's body or a portion thereof extends above the grip segment 840 of the bar assembly 800. A user may exercise a pulling motion of the upper body, and also a rowing motion of the upper body in this aspect.

In some aspects, the user may first position the user's upper body above or substantially above the grip segment 840 of the bar assembly 800. A user then may grip the grip surface 850 of the grip segment 840 and lower the user's upper body below or substantially below the grip segment 840 of the bar assembly 800, then the user may push on the grip segment 840 of the bar assembly 800 to raise the user's upper body back above or substantially above the grip segment 840 of the bar assembly 800. A user may perform a triceps dip or a pushing movement of the upper body in this aspect.

Shown in FIG. 4A, and in greater detail in FIGS. 10A-13, in some aspects and embodiments, the user may remove at least one bar assembly 800 from the internal storage space 140 located inside of the bench 15. In some embodiments, the bench 15 may not include an internal storage space and the user may retrieve the bar assembly 800 from another location. The user then may take the bar assembly 800 and align the main body 810 of the bar assembly 800 to the horizontal bar slot assembly 500. The user then may align the keying geometry of the bar assembly 800 with the keying geometry of the horizontal bar slot assembly 500 in one orientation of the bar assembly 800, corresponding to one position of the grip segment 840 of the bar assembly 800 with respect to the bench 15.

The user may then retract the lock pin 530 of the horizontal bar slot assembly 500 to allow the bar assembly 800 to slide into the horizontal bar slot assembly 500. The user then may slide the bar assembly 800 into the slot insert 510 of the horizontal bar slot assembly 500, until the bar assembly 800 comes to rest against the bottom of the slot insert 510 or bench 15. The user may then release the lock pin 530 of the horizontal bar slot assembly 500, and the lock pin 530 may be inserted back into the slot insert 510 of the horizontal bar slot assembly 500 and may be further inserted into the locking geometry 830 of the bar assembly 800. In the embodiment shown in FIG. 4A, the user may retrieve two bar assemblies 800 and insert one bar assembly 800 into each one of the two horizontal bar slot assemblies 500 on the bench 15.

The user then may grab the anti-tilt bar 710 by the grip portion 750 and slide the anti-tilt bar 710 outwards extending away from the bench 15. The anti-tilt bar 710, slidably fastened to the bench 15, may support the bench 15 and prevent it from tilting or tipping over during the user's subsequent exercises by extending the bench's center of gravity. In some aspects, the user may not need to extend outward the anti-tilt bar 710 from the anti-tilt assembly 700, as the anti-tilt bar 710 may not be needed for various squatting and lunging exercises described herein. In some embodiments, the anti-tilt assembly 700 functions as a counterweight assembly.

While the bar assembly or bar assemblies 800 may be installed in the horizontal bar slot assemblies 500, the user may then perform various exercises by holding on to the grip surface 850 of the grip segment 840 of the bar assembly 800 and utilizing the user's own body weight in addition to the weight of the exercise device 10 to perform exercise movements. In one aspect, the user may bend the user's knees in order to squat down to grip the grip surface 850 of the grip segment 840 of the bar assembly 800 in a squatted position, then the user may extend the user's legs to raise the bar assembly 800 and thus the exercise device 10 into the air. The user then may bend the user's legs back into a squatted position, returning the exercise device 10 back to the ground and to a rest position. In this aspect the user may perform a squatting motion with the user's own body weight and the additional weight of the device 10.

In some aspects, in an embodiment where the bench 15 may further include a wheel assembly 600, as shown in FIG. 4A, the user may bend the user's knees to squat down in order to grip the grip surface 850 of the grip segment 840 of the bar assembly 800 with the user's hands while facing towards the bench 15. The user then may extend the user's legs, raising the exercise device 10. The user then may extend one leg forward, pushing on the grip segment 840 of the bar assembly 800 which moves the exercise device 10 forward by rolling the exercise device 10 on the wheels 610 of the wheel assembly 600 that may be mounted to the bench 15. The user may thus perform a weighted lunge movement of the lower body in this manner.

In some aspects, in an embodiment shown in FIG. 4A, the user may bend over, hinging the user's body at the user's waist so that the user's back becomes substantially at a right angle with respect to the user's lower body in order to grip the grip surface 850 of the grip segment 840 of the bar assembly 800 with the user's hands while facing towards the bench 15. The user then may pull up on the grip segment 840 of the bar assembly 800, while still hinging at the waist, bringing the user's back to an upright position, while simultaneously lifting the bar assembly 800 and thus the exercise device 10. In this aspect, the user may perform a hinging movement at the waist, or "deadlift" exercise.

In some embodiments and aspects, such as the one shown in FIGS. 20-21, a user may perform other exercises with other modular attachments to the exercise device 10. In one such embodiment, the user may retrieve the leg curl attachment from the bench 15 internal storage space 140. In some embodiments, the bench 15 may not include an internal storage space 140, or the leg curl attachment may not fit in the internal storage space 140 and the user may retrieve the leg curl attachment from another location. The user first may retract the locking pin 970 of the attachment module 900 to provide an open channel to install the leg curl attachment 930 mounting member 920. The user may then align the mounting member 920 of the leg curl attachment 930 with the mounting sleeve 910 of the bench 15 attachment module 900. The user then may insert the locking pin 970, which allows the locking pin 970 to engage into both the bench 15 mounting sleeve 910 and any only of the holes 925 in the mounting member 920 of the leg curl attachment 930. The user may, in some aspects, connect resistance bands to the resistance band attachment points 160 of the bench and the leg curl attachment. The user then may support the user's legs on the leg pad 936 of the leg curl attachment 930, and may flex and extend the user's legs, while pivoting at the user's knees in order to perform a leg curl exercise. During this movement, the leg curl attachment 930 may pivot about the pinned connector 934 in the direction indicated by arrow 902. In some embodiments, the locking pin may be replaced by a push pin, and the user may push the pin to insert it into both the attachment module mounting features and the leg curl attachment mounting features.

In some aspects and embodiments, such as the one shown in FIGS. 20-21, the user may retrieve the arm curl attachment 940 from the bench 15 internal storage space 140. In some embodiments, the bench 15 may not include an internal storage space 140, or the arm curl attachment 940 may not fit in the internal storage space 140 and the user may retrieve the arm curl attachment 940 from another location. The user first may retract the locking pin 970 of the attachment module sleeve 910 to provide an open channel to install the arm curl attachment 940 mounting member 920. The user then may align the mounting member 920 of the arm curl attachment 940 with the mounting port sleeve 910 of the bench 15 attachment module 900. The user then may insert the locking pin 970, which allows the locking pin 970 to engage into both the bench 15 mounting port sleeve 910 and any one of the holes 925 on the mounting member 920 of the arm curl attachment 940. The arm curl attachment 940 may thus be attached to the bench 15 attachment module 900.

The user then supports the user's arms on the support surface or pad 944 of the arm curl attachment 940. The user then may hold in the user's hands-free weights, resistance bands, or a curl bar 946 that may be pivotally attached to the arm curl attachment 940 (for movement in the direction indicated by arrow 943), so that the user may extend and contract the user's arms, pivoting at the user's elbow, to perform an arm curl exercise. During this movement, the arm curl attachment 940 may pivot about the pinned connector 934 in the direction indicated by arrow 902.

In some aspects and embodiments, the user may retrieve the bench decline attachment from the bench 15 internal storage space 140. In some embodiments, the bench 15 may not include an internal storage space 140, or the bench decline attachment may not fit in the internal storage space 140 and the user may retrieve the bench decline attachment from another location. The user may first lift the bench 15 in order to place the bench decline attachment under the bench 15 and aligned with the bench 15 attachment module sleeve 910. The user may then retract the locking pin 970 of the attachment module sleeve 910 to provide an open channel to install the bench decline attachment mounting member. The user then may align the mounting features of the bench decline attachment with the locking pin 970 of the bench 15 attachment module sleeve 910. The user then may release the locking pin 970, which allows the locking pin 970 to engage into both the bench 15 mounting port sleeve 910 and any one of the holes on the mounting member of the bench decline attachment. The bench decline attachment may thus be attached to the bench 15 attachment module 900. The user may then use the bench 15 in a declined angle position to perform various pushing movements of the upper body, as described above.

The systems and methods described herein offer multiple benefits to those in the physical bodily exercise industry.

While various aspects and embodiments have been disclosed herein, some aspects and embodiments will be apparent to those skilled in the art. The various aspects and embodiments disclosed herein are for purposes of illustration and are not intended to be limiting, with the true scope and spirit being indicated by the following claims. Some embodiments may be utilized, and other changes may be made, without departing from the spirit or scope of the subject matter presented herein. It will be readily understood that the aspects of the present disclosure, as generally described herein and illustrated in the figures, can be arranged, substituted, combined, separated, and designed in a wide variety of different configurations, all of which are contemplated herein.

What is claimed is:

1. An apparatus, comprising:

a main bench body comprising a first surface;

a plurality of slots located on the main bench body, each of the plurality of slots comprising a first keying feature comprising a first shape;

wherein a first pair of slots is substantially perpendicular to the first surface of the main bench body; and wherein a second pair of slots is substantially parallel to the first surface of the main bench body; and at least two bars, each bar comprising:

a main body configured to be slidably inserted into the slots, the main body comprising a second keying feature comprising a second shape, the second shape comprising at least one orientation of the main body, the second shape configured to interact with the first shape of the first keying feature in the at least one orientation of the main body; and a grip segment extended at an angle from the main body, the grip segment comprising at least one orientation relative to the main bench body corresponding to the at least one orientation of the main body;

wherein in a first configuration, the at least two bars are in the first pair of slots and are configured to support loading each main body of the at least two bars in compression;

wherein in a second configuration, the at least two bars are in the second pair of slots, and are configured to support loading each main body of the at least two bars in bending;

a counterweight assembly adjustably attached to the main bench body.

2. The apparatus of claim 1, wherein the main bench body further comprises a second surface comprising a front portion and a rear portion, each of the front portion and the rear portion configured to pivot with respect to the main bench body.

3. The apparatus of claim 1, wherein at least one wheel is fastened to the main bench body.

4. The apparatus of claim 1, wherein the at least two bars each further comprise a first lock feature and the second pair of slots each further comprise a second lock feature configured to interact with the first lock feature to secure a position of the at least two bars relative to the second pair of slots.

5. The apparatus of claim 1, wherein the counterweight assembly is a removable attachment comprising a pinned connection, a mounting point for additional weight, and an additional hinge point allowing movement of the additional weight.

6. The apparatus of claim 1, further comprising an internal storage space within the main bench body.

7. The apparatus of claim 1, further comprising resistance band attachment points fastened to the main bench body.

8. The apparatus of claim 1, further comprising an attachment module fastened to the main bench body, the attachment module configured to removably and adjustably attach a leg curl and extension attachment, an arm curl and extension attachment, and a bench decline attachment to the main bench body.

9. An apparatus, comprising:

a main bench body;

at least two slots located on the main bench body, each of the at least two slots configured to slidably and removably receive a bar in at least one fixed position;

at least two bars, each bar comprising a shape configured to be slidably inserted into a corresponding one of the at least two slots on the main bench body in the at least one fixed position;

a back rest pivotally mounted to the main bench body;

a seat rest pivotally mounted to the main bench body;

a first pair of two slots located on the main bench body, each of the two slots further comprising at least one first keying feature comprising a first shape; and wherein each of the at least two bars further comprises:

a main body configured to be slidably inserted into each of the two slots, the main body comprising a second keying feature comprising a second shape, the second shape comprising at least one orientation of the main body, the second shape configured to interact with the first shape of the at least one first keying feature in the at least one orientation of the main body; and a grip segment extended at an angle from the main body, the grip segment comprising at least one orientation relative to the main bench body corresponding to the at least one orientation of the main body.

10. The apparatus of claim 9, further comprising a second pair of two slots located on the main bench body, wherein the first pair of slots is substantially perpendicular and the second pair of slots is substantially parallel to a first surface of the main bench body.

11. The apparatus of claim 9, further comprising at least one wheel fastened to the main bench body.

12. The apparatus of claim 10, wherein the at least two bars further comprise a first lock feature and the second pair of slots further comprise a second lock feature.

13. The apparatus of claim 9, wherein at least one support lever is adjustably attached to the main bench body.

14. The apparatus of claim 9, further comprising an internal storage space within the main bench body.

15. The apparatus of claim 9, further comprising resistance band attachment points attached to the main bench body.

16. An apparatus, comprising:

a main bench body;

at least two slots located on the main bench body, each of the at least two slots configured to slidably and removably receive a bar in at least one fixed position;

at least two bars, each bar comprising a shape configured to be slidably inserted into a corresponding one of the at least two slots on the main bench body in the at least one fixed position;

a back rest pivotally mounted to the main bench body;

a seat rest pivotally mounted to the main bench body; and an attachment module fastened to the main bench body, the attachment module configured to removably and adjustably attach a leg curl and extension attachment, an arm curl and extension attachment, and a bench decline attachment to the main bench body.

17. A weight bench comprising:

a main bench body;

a plurality of bars selectively couplable to the main bench body and movable between a first position and a second position, wherein in the first position the bars are positioned at a first angle relative to the main bench body, wherein in the second position the bars are positioned at a second angle relative to the main bench body, the second angle being different from the first angle, wherein the bars are adapted to hold a barbell in at least one of the first position or the second position;

wherein the main bench body comprises first slots at first locations thereon, wherein the bars are slidably insertable into the first slots and are in the first position when inserted into the first slots; and wherein the main bench body comprises second slots at second locations thereon, the second locations being different from the first locations, wherein the bars are slidably insertable into the second slots and are in the second position when inserted into the second slots.

* * * * *